US012747054B2

(12) United States Patent
Hess et al.

(10) Patent No.: US 12,747,054 B2
(45) **Date of Patent: *Sep. 29, 2026**

(54) BAG OPENING VERIFICATION SYSTEM AND METHOD FOR OPERATING A BAGGING MACHINE

(71) Applicant: Pregis LLC, Chicago, IL (US)

(72) Inventors: Benjamin John Hess, West Allis, WI (US); James Matthew O'Gorman, Hartford, WI (US); William Harry Stock, Sullivan, WI (US); Daniel John Folger, Oconomowoc, WI (US)

(73) Assignee: Pregis LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/025,900

(22) Filed: Jan. 16, 2025

(65) Prior Publication Data

US 2025/0153877 A1 May 15, 2025

Related U.S. Application Data

(63) Continuation of application No. 16/599,679, filed on Oct. 11, 2019, now Pat. No. 12,559,276.

(60) Provisional application No. 62/745,860, filed on Oct. 15, 2018.

(51) Int. Cl.

| | |
|---|---|
| ***B65B 43/12*** | (2006.01) |
| ***B65B 43/26*** | (2006.01) |
| ***B65B 43/30*** | (2006.01) |
| ***B65B 51/14*** | (2006.01) |
| ***B65B 61/02*** | (2006.01) |
| ***B65B 67/02*** | (2006.01) |

(52) U.S. Cl.
CPC ..... *B65B 43/123* (2013.01); *B65B 43/267* (2013.01); *B65B 43/30* (2013.01); *B65B 51/146* (2013.01); *B65B 61/025* (2013.01); *B65B 67/02* (2013.01)

(58) Field of Classification Search
CPC ... B65B 43/123; B65B 43/267; B65B 61/025; B65B 51/146; B65B 43/30
See application file for complete search history.

(56) References Cited

U.S. PATENT DOCUMENTS

| | | | |
|---|---|---|---|
| 4,056,132 | A | 11/1977 | Decrane |
| 4,996,819 | A | 3/1991 | Davis |
| 5,855,106 | A | 1/1999 | Koyama et al. |
| 6,688,346 | B2 | 2/2004 | Brahier et al. |
| 6,779,321 | B1 | 8/2004 | Kelemen |
| 6,789,963 | B2 | 9/2004 | Brahier et al. |
| 6,857,455 | B2 | 2/2005 | Brahier et al. |
| 10,836,525 | B1 | 11/2020 | Alspaugh |
| 2004/0022569 | A1 | 2/2004 | Brahier et al. |

(Continued)

*Primary Examiner* — Daniel Jeremy Leeds
(74) *Attorney, Agent, or Firm* — Fox Rothschild LLP

(57) ABSTRACT

A bagging machine may include a supply handling assembly, a bag loading assembly and a controlled, which may control certain operations of the bagging machine. The bag loading assembly may include a bag opening assembly that reciprocates back and forth and which supports movable film grippers. The bagging machine may be provided with one or more sensors operatively positioned to detect whether a film is present between the grippers, such as during an opening sequence, and the controller may be configured to modify the operation (e.g., interrupt or re-start an opening sequence, generate an alert signal, etc.) of the bagging machine based on the data received from the sensor.

17 Claims, 23 Drawing Sheets

(56) References Cited

U.S. PATENT DOCUMENTS

| | | | |
|---|---|---|---|
| 2006/0162291 | A1 | 7/2006 | Gates et al. |
| 2014/0036276 | A1 | 2/2014 | Gross et al. |
| 2015/0298321 | A1 | 10/2015 | Gross et al. |
| 2016/0052767 | A1 | 2/2016 | Eaton et al. |
| 2017/0129632 | A1 | 5/2017 | Williams et al. |
| 2018/0347754 | A1 | 12/2018 | Miller et al. |
| 2020/0369416 | A1 | 11/2020 | Pape |

BAG OPENING VERIFICATION SYSTEM AND METHOD FOR OPERATING A BAGGING MACHINE

CROSS-REFERENCE TO RELATED APPLICATIONS

The present application is a continuation of U.S. Ser. No. 16/599,679, filed on Oct. 11, 2019, which claims under 35 U.S.C. § 119(e) the benefit of U.S. Provisional Application No. 62/745,860, filed Oct. 15, 2018, the entire contents of which are incorporated by reference herein.

TECHNICAL FIELD

The present disclosure relates to packaging machines and more specifically to bagging machine with automated bag opening and a bag open verification assembly and methods.

BACKGROUND

It is known to package and ship discrete quantities of one or more products, such as fasteners, seals or other hardware, assembly kits, shoes, clothing, apparel, and other products, in individual containers (e.g., mailers) that can be delivered to subsequent users or consumers of the packaged products. For example, many internet based sales activities, such as eBay®, Amazon®, source or manufacturer direct suppliers, etc., allow a user or consumer to purchase various goods and/or materials either directly from a manufacturer and/or from intermediary service providers and facilitate the delivery of the ordered goods directly to the purchaser. Many such products can be packaged in web-type material containers and delivered directly to the consumer. The web-type material containers are commonly referred to as tubes or bags and are formed of various types of plastic materials. As the desire to purchase products through non-brick and mortar or "mail order" sales streams has increased, so has the need to expeditiously, accurately, and securely package, label, and distribute various types of goods to downstream product users and consumers. Large volume retailers have an even greater need to quickly and inexpensively bag products being sent to customers.

Some companies use a continuous strip bag feeder and loader apparatus, commonly referred to as "feeder/loaders," such as those disclosed in U.S. Pat. Nos. 6,857,455; 6,789,963; and 6,688,346, owned by the Applicant. The disclosures associated with the patents cited above are expressly incorporated herein. It is appreciated that strip bag feeders such as those disclosed in the patents referenced above can be configured for sequential operation with web material containers, bags, or web material tubes having various sizes, shapes, and configurations. Commonly, the web material containers associated with use of such feeder/loaders can be provided with various separable perforations, be severable or provided a pre-formed bag opening so as to provide a series of interconnected but separable plastic product containers. For example, similar to a bag feeder and label printer portions of the assembly described below with respect to FIG. 1, many such feeder/loaders use continuous strips of bags that are end connected or a continuous tube of bag material. Each of the bags in the continuous strip web material can include an open end or an end that is openable via at least a partial separation or perforation and that is connected to a closed or sealable end defining the next bag in the continuous strip. Additionally, many such feeder/loader assemblies can also include a printing station which prints a design and/or shipping information on label applied to the bag or directly to the discrete bag material itself as the material is fed from the roll into a respective product bag loading station.

As the popularity of such bag packaging assemblies increased due to their speed, accuracy, and efficiency, designers and manufacturers of such bagging machines continue to seek improvements thereto.

SUMMARY

A bagging machine according to some embodiments may include a supply handling assembly that supports a supply of converted web material and a bag loading assembly that includes one or more reciprocating components that enable the automated opening and closing of individual bags of the supply material as the supply material is advanced along the processing path of the machine. The supply of converted web material may include a plurality of individual bags connected in a continuous web with transverse perforations extending at least partially along a transverse dimension of the web to define openings of the individual bags, and the supply handling assembly may, in operation, feed the converted web material toward a bag loading area of the machine.

The bag loading assembly may include rear film control components operatively positioned near the bag inlet to control the rear side of the bag opening, and a moveable bag opening assembly, which in use reciprocates in relation to the bag inlet to effect the automated opening and closing of the bag. In some embodiments, the bag opening assembly includes at least one front film control element that engages the front side of the bag. The front film control element may include gripper portions (or simply grippers) operatively arranged to grip the front side of the bag near the bag opening. The one or more front film control element may be movably supported on a pressure plate that reciprocates back and front in relation to the bag inlet to enable the automated opening and closing of the bag. The bag loading assembly may be equipped with one or more sensors mounted in a fixed relationship to the second film control element do detect whether a film is present between the grippers. The bagging machine may also include a control system (e.g., a microcontroller) which modifies the operation (e.g., an opening sequence) of the bagging machine based on data received from the sensor. For example, the control system may be configure to pause or interrupt an opening sequence based on sensor data that indicates that a bag is not present between the grippers of the front film control element during the opening sequence.

Methods for operating a bagging machine are also disclosed. In accordance with one embodiment, a method may include providing a supply of converted web material to a bagging machine, wherein the converted web material includes a plurality of individual bags connected in a continuous web with transverse perforations extending at least partially along a transverse dimension of the web to define openings of the individual bags. The method may further include advancing the converted web material toward a bag inlet of the bagging machine, and translating a pressure plate away from a bag inlet of a bag loading assembly to initiate opening the bag, wherein the pressure plate supports a gripper assembly and a sensor fixed to the gripper assembly. While translating the pressure plate away from the bag inlet, the method may include receiving sensor data from the sensor for determining whether the bag is gripped by the gripper assembly, and modifying an operational sequence of the bagging machine upon a determination that the bag is not gripped by the gripper assembly. For example modifications to the operation of the machine responsive to a bag not present indication may include pausing or interrupting an opening sequence, re-starting the opening sequence, terminating the opening sequence, and/or generating a fault signal, which may involve generating an alert, logging a fault, or the like.

In some embodiments, the bag loading assembly may include a rear film control assembly that includes at least one first film control element operatively associated with the bag inlet to control a rear side of the opening of an individual bag.

BRIEF DESCRIPTION OF THE DRAWINGS

FIGS. 15A-15I are views of a bag opening assembly in accordance with further examples of the present disclosure.

DETAILED DESCRIPTION

The present disclosure is related to bagging machines with a bag-open verification system and related methods for operating a bagging machine.

A product bagging assembly according to the present disclosure may include may include a bagging machine which includes a supply handling assembly configured to support a supply of converted web material and to feed the converted web material toward a bag loading area of the machine and a bag loading assembly configured to open individual bags of the continuous web as the web exits a pass through and enters the bag loading area for loading product into the opened bag. The bag loading assembly may be further configured to close and seal the loaded bag, and the loaded bag is then separated typically automatically by the machine or in some cases manually, before the next bag is advanced and opened for loading. The bagging machine may include or be communicatively coupled to a control system which controls operation of one or more components of the bagging machines, such as components of the bag loading assembly.

Figure 1:
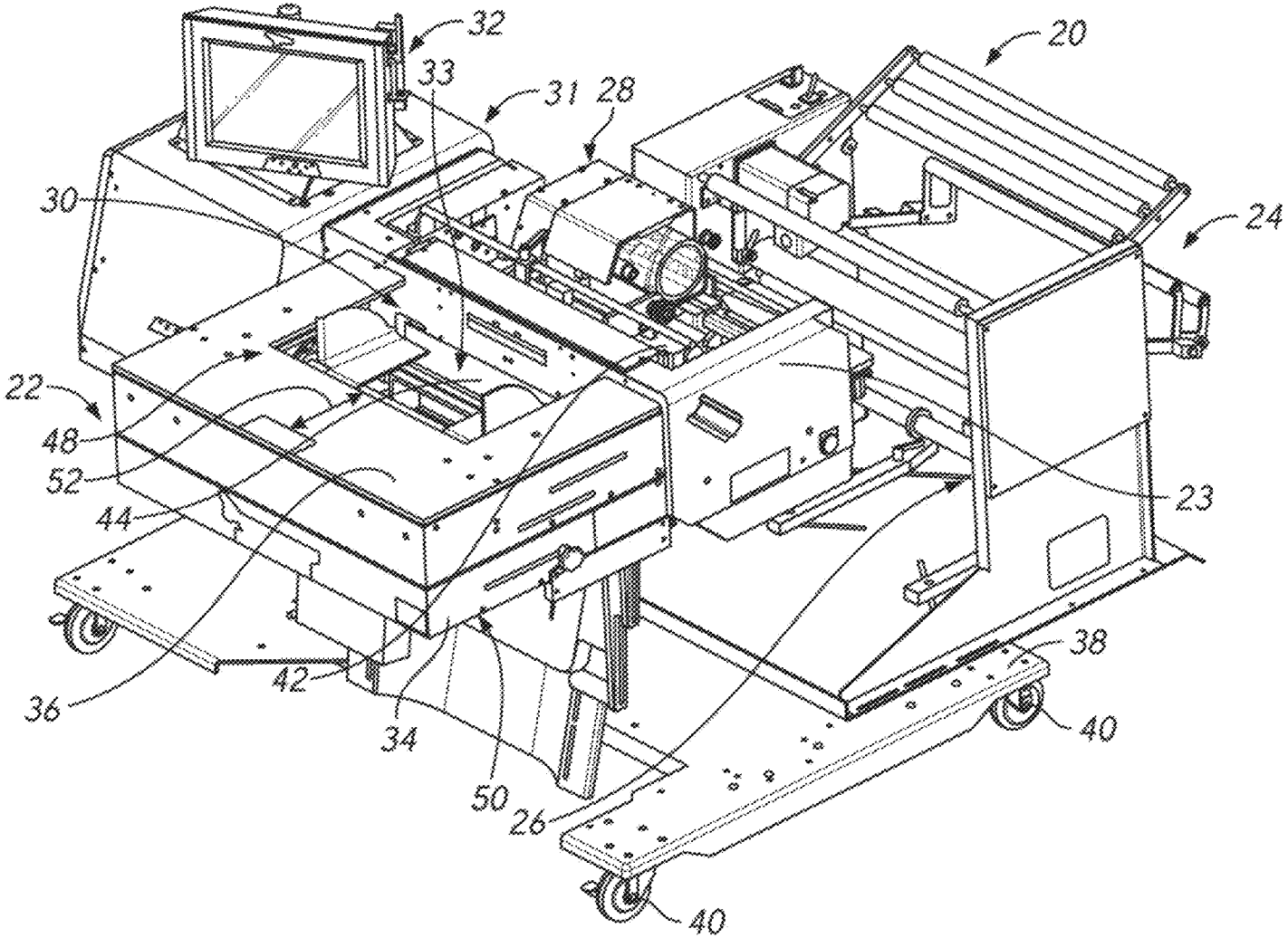
FIG. 1 is a view of a bagging machine in accordance with the presence disclosure.

Referring to FIG. 1, a product bagging system 20 according to the present disclosure includes a bag loading assembly 22, also referred to as product loading station or product bagging assembly 22. The product bagging system 20 includes a supply handling assembly, which is configured to support a supply of converted web material and which feeds the web material toward a bagging area of the bag loading assembly 22. In the illustrated example, the product bagging system 20 includes bag feeder/loader or bag delivery assembly 23 associated with a payoff system 24 that includes a roll support or loading station 26. A supply support assembly (e.g., loading station 26) configured to support bulk volume or supply of web material, which may be provided in any suitable configuration such as a roll or a fan-folded configuration, is associated with the supply handling assembly and is passed downstream toward the bagging area, e.g., through payoff system 24. In examples, the web material is delivered to a printing station 28 prior to being communicated, via bag delivery system 23, to the bag loading area 33, in which a product may be loaded into the bag via a product pass through 30.

Figure 3:
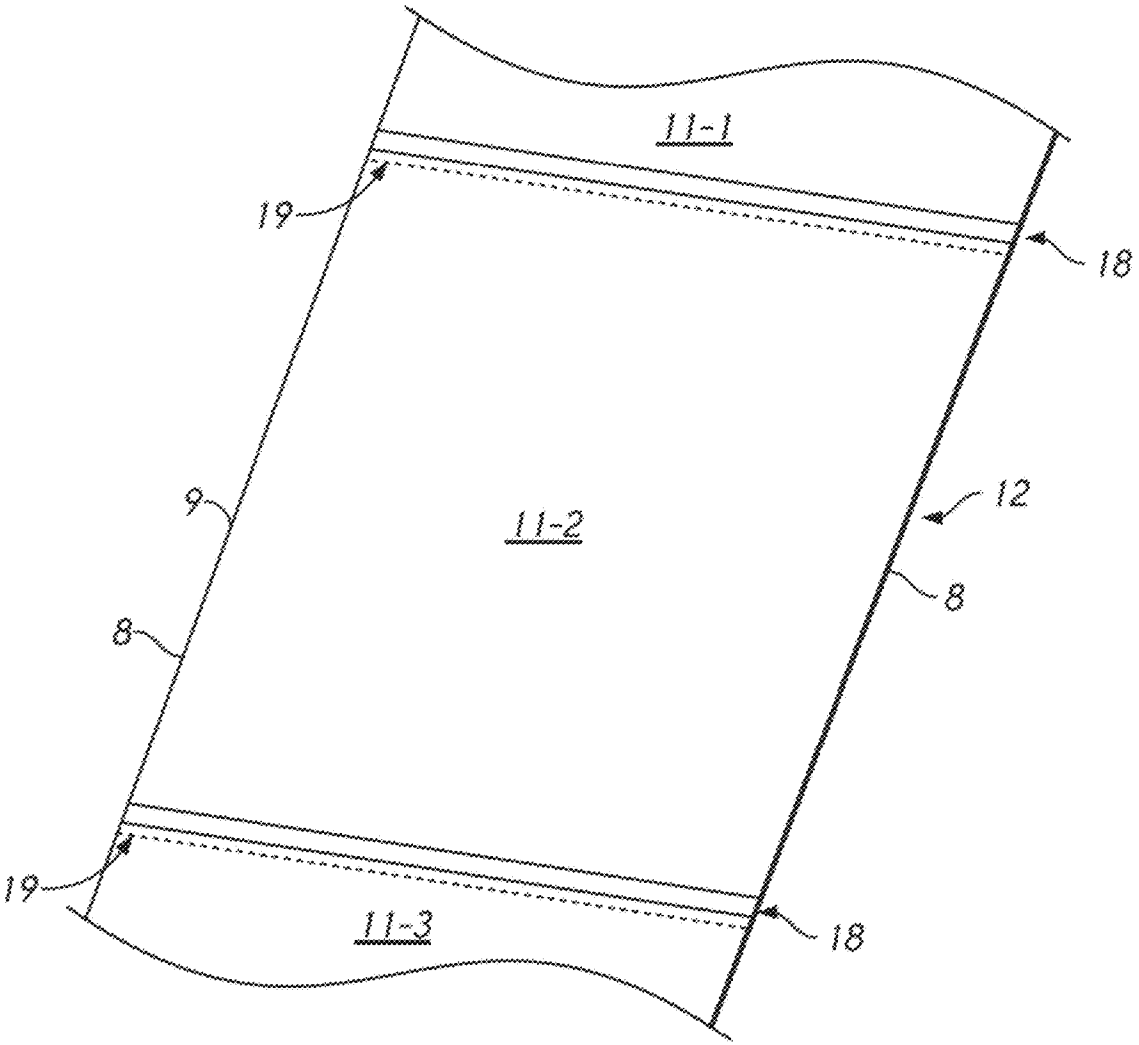
FIG. 3 is an illustration of a portion of a converted web material.
Figure 4:
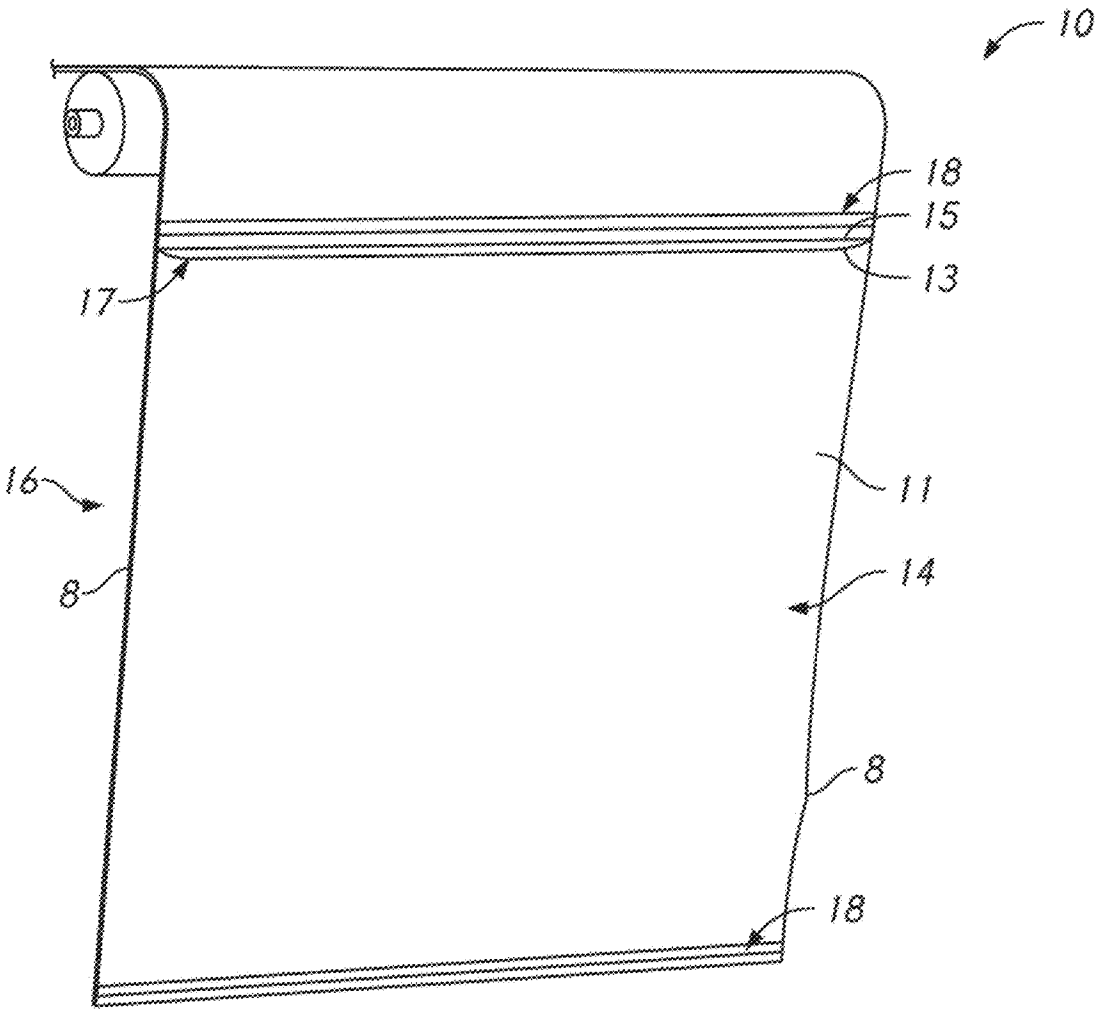
FIG. 4 is an illustration of a supply of converted web material in an exemplary configuration.

As shown in FIGS. 3 and 4, an example of a web 12 of converted material. The web 12 of converted material is a multi-ply film structure 9, which defines a plurality of individual pockets or bags 11 between upper and lower plies 13 and 15, respectively. The bags 11 are connected in a continuous web 12. FIG. 3 illustrates a portion of a continuous web of converted material, showing an individual bag 11-2 and portions of the individual bags 11-1 and 11-3 upstream and downstream, respectively of the bag 11-2. It will be understood that the term downstream is used to describe relative direction or positioning of elements with respect to a direction of travel of the web from the supply toward and exit of the bagging machine. In other words, an element to component which is downstream from another element or component is farther away from the supply end of the web or machine when in use and thus further along the direction of travel as compared to upstream elements.

Each of the pockets or bags 11 has front and back walls 14 and 16, respectively, provided by upper and lower plies, 13 and 15 respectively, of the multi-ply film structure 9. The converted web may be formed into the multi-ply film structure 9 from raw material (e.g., a film of plastic material), such as by folding the film material along a longitudinal fold line to form one of the longitudinal edges 8 and joining the plies to form the other longitudinal edge 8, or by overlaying the upper and lower plies and joining them along both longitudinal edges. In some cases, one or both of the front and back walls 14, 16 may themselves be multi-ply structures, e.g., in the case where a padding material is provided on one or both sides of the bag (e.g., sandwiched between interior and exterior layers of the wall structure). Additionally, to define the individual pockets or bags 11, transverse seals 18 are formed at longitudinally-spaced locations of the web. Adjacent and slightly downstream of each longitudinal seal, perforations 19 extending through the upper and lower plies of the multi-ply structure are provided for subsequently opening and separating the individual bags 11. The perforations 19 through the upper ply (or plies, in the case of multi-ply walls) are separated during the conversion process to form a bag opening 17, while the perforations through the lower ply (or plies, in the case of multi-ply walls) are left intact such that the individual bags remain connected into a continuous web after the web conversion and prior to the bag loading process. The converted web of material is provided in supply configuration such as wound into a roll 10 (see FIG. 4) or provided into a fan-folded configuration for delivery and coupling to the bagging machine.

Referring back to FIGS. 1 and 2, in one embodiment, a roll, which can be a continuous roll of plastic material bags, which may be partially perforated along intended tear or bag opening lines, is fed from loading station 26, up through a number of rollers associated with payoff system 24, to the printing station 28. In one embodiment, each bag, while in the continuous roll or folded arrangement of what will ultimately define multiple discrete product containing bags, is attached to the neighboring bags by perforations. Each bag is generally defined by a front side and a back side that are bounded by edges. One or more of the left side edges, right side edges, and bottom edges can be sealed and the top edge or area proximate thereto can be provided with an open or partially perforated top edge portion which can be selectively opened or severed during the product loading process and subsequently sealed to secure the packaged contents within the confines of a respective bag.

In some configurations, the top of the rear or back portion of the bag is attached to the neighboring bag by the above described perforations. Disposed generally proximate the top of the front of the bag is a mouth or lip of the bag that is only attached to the rear portion of the bag at the right side and left side and is free to be manipulated as will be further discussed below. Alternatively, selectively tearable perforations can be formed proximate or at the top edge associated with the front and rear sides of a respective bag and severable to define a desired opening size and shape of each respective bag during product loading. It should, be appreciated that the description above is merely exemplary of a few of many web material containers useable with product bagging system 20.

Regardless of the web material utilized, at the printing station 28, signage, such as a graphic associated with identification of the contents of a package, product or supplier designs such as a company's logo or trademark, as well as shipping information and/or instructions, for example fragile, is preferably printed directly on the bag or printed to a label adhered to a respective bag. After a portion of the web material or a respective label has been printed and/or adhered to a respective bag, a portion of the web material associated with forming a discrete product bag advances to product pass through 30 and is manipulated by operation of product bagging assembly 22 to open the respective bag to have a desired opening, throat, or mouth size and shape for receipt of respective product as described further below.

Product bagging system 20 includes a control system 31 configured to control operation of the bagging machine. The control system 31 includes a processor, memory, which may store executable instructions, and may be operatively associated with a user interface 32, which may include a display and/or other user interface devices (e.g., keyboard, mouse, touch-screen display, etc.). In some embodiments, the control system 31 may be configured to receive operational instructions from an operator via one or more user interface devices (e.g., mouse, keyboard, touch screen, or other inputs such as flash drives and/or network connections). In some embodiments, the system 20 may be configured to operate without the involvement of a human operator, such as where loading of product in the bags is performed by a robot, and the system 20 may in such instances also control via a wired or wireless connection to the robot, certain functions and operation of the product loading robot.

Still referring to FIG. 1, product bagging assembly 22 of product bagging system 20 includes a chassis 34 and a shroud 36 or the like associated with selectively isolating the internal workings of product bagging assembly 22 from dirt, debris, product to be packaged, as well as users or operators. Product loading station 22 can further include one or more hand stations or contacts associated with providing a user confirmation that the desired product has been provided via the pass through 30 to the open bag disposed in the bag loading area 33. Although shown in what is commonly understood as a vertical loading configuration, it is appreciated that one or more of product loading station 22, printing station 28, payoff system 24, and/or bag feeder 23 can be rotationally supported so as to provide vertical, horizontal, or canted or pitched user interaction with the product bagging system 20 and specifically product loading station 22. In a preferred embodiment, product bagging system 20 is supported by a cart 38 having one or, more casters 40 to accommodate desired or various placement of system 20 within a given operating environment.

Still referring to FIG. 1, bag delivery assembly 23 includes a conveyor 42 configured to advance the web material comprising the connected individual bags, toward the bag loading area 33. The web may be provided into the bag loading area 33 via a bag inlet 44, which in the illustrated embodiment includes a channel or slot through a wall structure between the bag delivery assembly 23 and the product bagging assembly 22. The wall structure may be omitting in some embodiments. In some embodiments, the wall structure may support additional components (e.g., air knife 43) described further below. Product bagging assembly 22 opens respective bags and then, after product loading, seals the respective bags prior to introduction of a subsequent bag to the bag loading area 33. It is appreciated that chassis 34 and shroud 36 of product bagging assembly 22 could be formed of multiple connected panel-like structures and/or formed as a more unitary structure such that product pass through 30 defines a product inlet 48 and a bagged product outlet 50 that generally overly one another. In some embodiments, the size of the pass through 30 may be adjustable, e.g., by moving various components including the shroud 36, chassis 34, and other internal components in the direction indicated by arrow 52 to provide variable sized product pass through inlet 48 sizes based upon the size of products intended to be packaged. A bagging machine with an adjustable pass through may be implemented in accordance with any of the embodiments described in U.S. Pat. Appl. Pub. 2017/0129632, titled "Bagging Machine and Method," assigned to applicant, the full content of which is incorporated herein by reference for any purpose.

Figure 2:
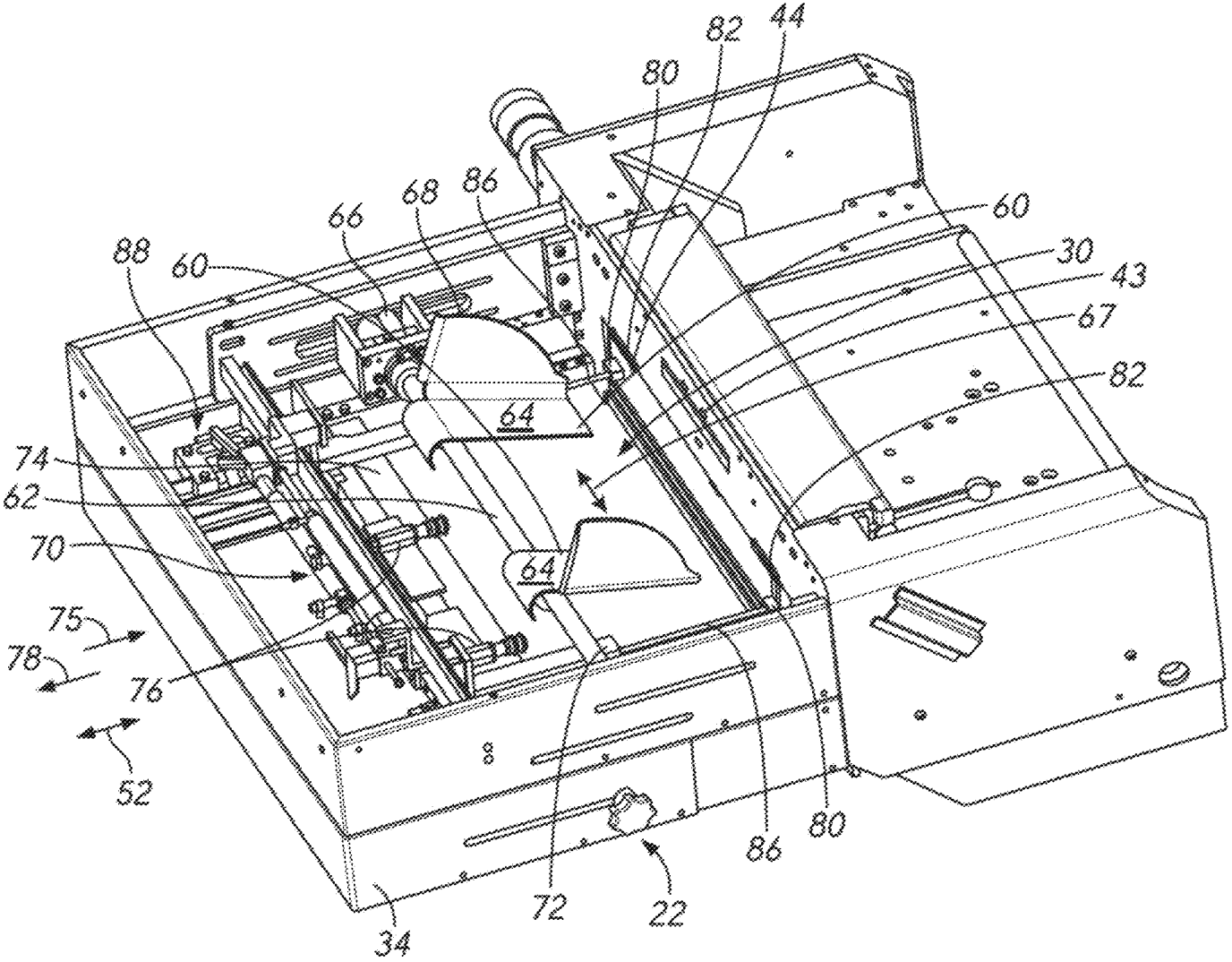
FIG. 2 is a view of a portion of the bagging machine in FIG. 1.

FIG. 2 shows a product bagging assembly 22 with shroud 36, various chassis portions, and various bag opening or manipulating assemblies selectively removed from bagging assembly 22 to illustrate certain internal components of the bagging machine. As described further below, it will be appreciated that product bagging assembly can be individualized to achieve the desired operation of product bagging assembly 22 associated with different product and bag shape, size, and configurations.

Product bagging assembly 22 includes various bag manipulation structures to effectuate a desired opening, packaging, closing, and sealing of a respective empty and packaged product bag. Referring to FIG. 2, product bagging assembly 22 can optionally include one or more product guides 60, supported by a rotatable guide shaft 62 that is fixed or slideably supported by chassis 34. The guides 60 may be shaped such that, upon introduction of a bag to the bag loading area 33 via the bag inlet 44, the guides 60 accommodate passage of a product along an upper surface 64 generally between the guides and into the volume of an opened bag. The guides 60 may be slidably supported on the guide shaft 62 such that they are movable in a generally lateral direction, indicated by arrow 67, to accommodate use of guides 60 with bags of various widths. A drive device 66, such as a motor, cooperates with guide shaft 62, to attain the desired orientation of guides 60, relative to a staging and loading process. One or more slots 68 associated with chassis 34 can be provided to accommodate a slideable cooperation of guide shaft 62 in bag opening and closing direction 52 relative to the bag inlet 44 to facilitate use of guides 60 throughout the loading process or use of a guide or guides having other shapes. Alternatively, it is appreciated that guides 60 could be biased out of interference with manipulation of bag opening assembly and deflectable in response to user interaction to tilt product into an underlying open bag. It is further appreciated that for some manual and many automated product packaging processes, guides 60 may be omitted or removed from product bagging assembly 22.

As illustrated in FIG. 2, a bag opening assembly 70 is supported by a carriage 72 that is slideable relative to chassis 34 in directions 52, e.g., for adjusting a size of the pass through opening. A pressure plate or cross member 74 supports one or more bag tensioning or opening devices 76, such as vacuum assist devices, configured to engage a front facing side of each respective bag. During packaging processes, cross member 74 moves in a closing direction 75 or toward slot 44 to engage bag and subsequently an opening direction 78 to effectuate separation of the alternate sides of a respective bag and thereby forming the opening or mouth associated with the underlying bag. It is appreciated that in some applications, air knife 43 may provide a sufficient open configuration for bags having a hysteresis capable of maintaining an open mouth orientation such that cross member 74 need not engage a respective bag. Generally, relatively smaller sized bags are capable of such use of product bagging assembly 22. In some examples, an air knife 43 may be used in place of or in addition to the bag opening devices 76. An air knife 43 may include an assembly configured to direct a flow of air substantially tangentially to the web as it exits through slot 44 for opening or initiating the opening of the bag. In some embodiments, an air knife may thus be used to create an initial opening and then an additional opening mechanism such as a vacuum assist device or a gripping device, may engage the upper layer(s) of the bag to fully open the bag for loading.

In one mode of operation, after a product has been disposed in a respective bag, cross member 54 returns toward slot 44 and compresses a respective bag against a sealing assembly disposed proximate thereof. Before the pressure bar or cross member 54 retracts or disengages the top of a respective bag, conveyor 42 can operate in a reverse direction to tear perforations between discrete bags associated with a roll of bags to effectuate separation of a packaged bag from the remaining web material. Once a packaged bag is torn from the roll of bags, cross member 74 can translate in an opening direction 78 to allow the packaged bag to drop out of the product bagging assembly. Instead of reversing the web, other means such as using a knife, pulling, pinching or burning, may be used to separate the packaged bag from the web, all of which are contemplated in bagging machine according to the present disclosure.

When utilized, bag opening devices 76 can slideably cooperate with cross member 74 to achieve the desired positioning of opening devices 76 relative to discrete bags delivered through slot 44. That is, devices 76 can be positioned nearer one another for smaller bags and further from one another for larger bags. Bag opening assembly 70 can also include one or more optional tensioners or bag edge retainers 80 that are rotatable about an axis generally aligned with direction 52. Initial opening of a bag can be effectuated by air knife 43 and/or the rotation of one or more fingers 82 associated with retainers 80 into the opening of a respective bag during the opening, loading, and closing of a respective bag. Depending on the configuration of the utilized bags, fingers 82 and the translation of cross member 74 may cooperate with one another to form a desired bag mouth opening by separation of the upper and lower layers at opening perforation associated with the underlying bag. When used to effectuate such manipulation, fingers 82 and cross member 74 cooperate with one another to maintain a secure edge between the opposing faces of each respective bag.

Depending on the operational packaging parameters, in some situations it may be preferred to have a wide, but narrow opening, a generally rectilinear or square shaped bag opening, or other bag opening shapes. Cross member 74 and fingers 82, or other finger orientations as described above and below, can each be adjusted to provide the desired bag opening shape. The fingers 82 could also be positioned laterally to help create the rear boundary or trapezoidal shapes associated with the bag openings (see, e.g., FIG. 5). If suction mechanisms are utilized as bag opening devices 76, the suction mechanisms can be laterally set relative to shaft 62 to create the desired width of the bag opening. The exact distance between the guides 60 fingers 82, and suction mechanisms 76 can each be independently adjusted to create a bag opening having a desired shape associated with the size of the bag utilized for various bag sizes.

In some embodiments, retainers 80 are also translatable in directions 52 to provide securing of sides of the respective bag that extends between slot 44 and cross member 74 dining the bag opening and closing operations. Such a consideration allows each bag to be presented with a generally taut edge associated with the mouth of a respective bag and generation of flat bag edge during the closing and sealing processes. In some embodiments, the retainers 80 and the drive system associated therewith, may be omitted or removed, such as when the bagging machine is utilized with bags having smaller cross-sectional openings and/or when using different retainer mechanisms. For instance, one or more forward oriented retainers may be supported by the cross member 74. These retainers moveable components which are connected to a suitable drive arrangement for moving the moveable components in a desired direction, e.g., by rotating fingers into the opening of the bag so as to grip or otherwise engage the bag for opening the bag. It is envisioned that for some applications, such retainers may be operated with or without the assist of vacuum tensioners 76. It is further appreciated that product guides 60 and the drive arrangement or device 66 associated therewith, may also be omitted or selectively included with product bagging assembly 22 depending upon the nature of the product and the size of the bags associated with use thereof.

Figure 5:
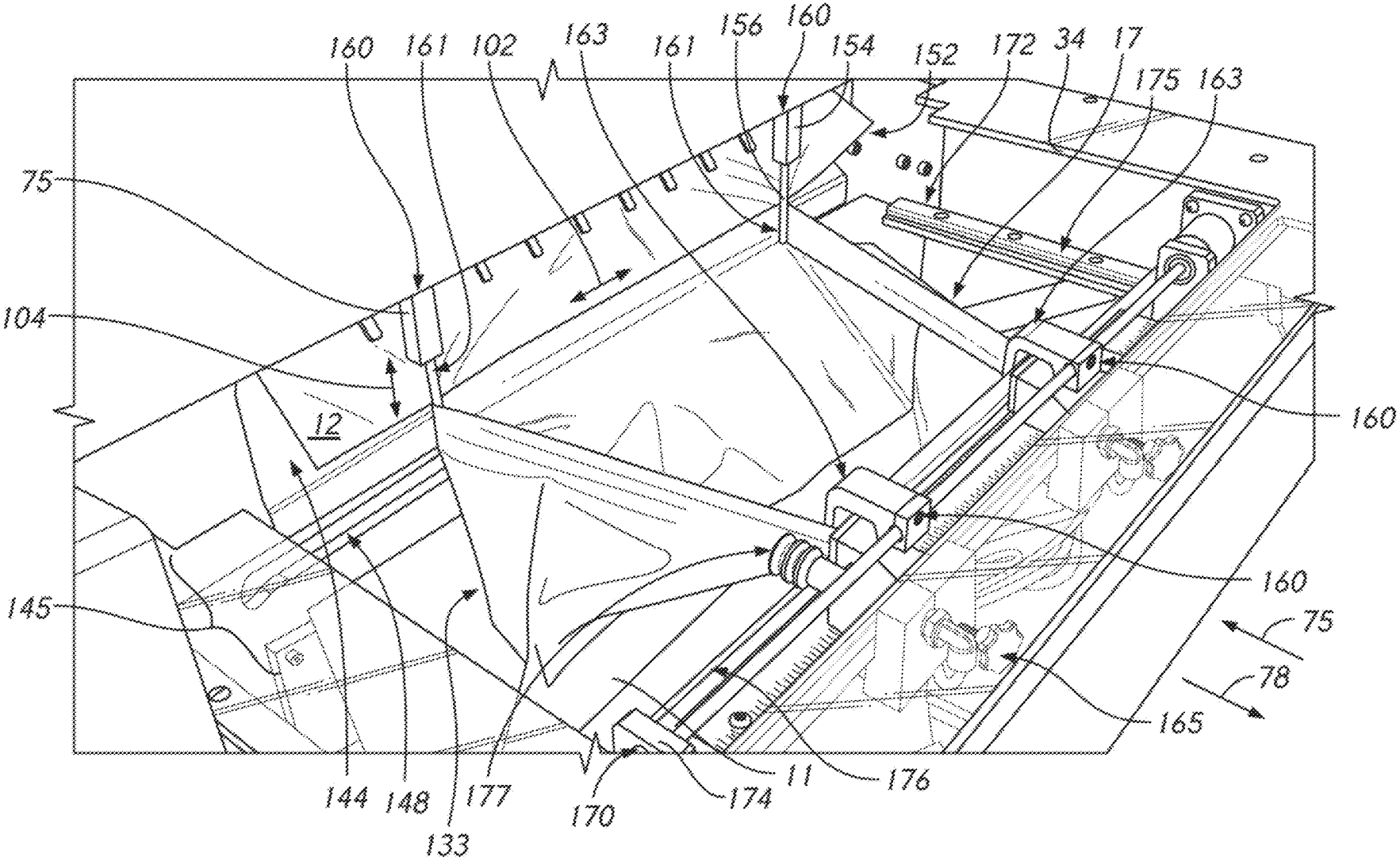
FIG. 5 is a view of a bag loading assembly of a bagging machine in accordance with some examples of the present disclosure.
Figure 6:
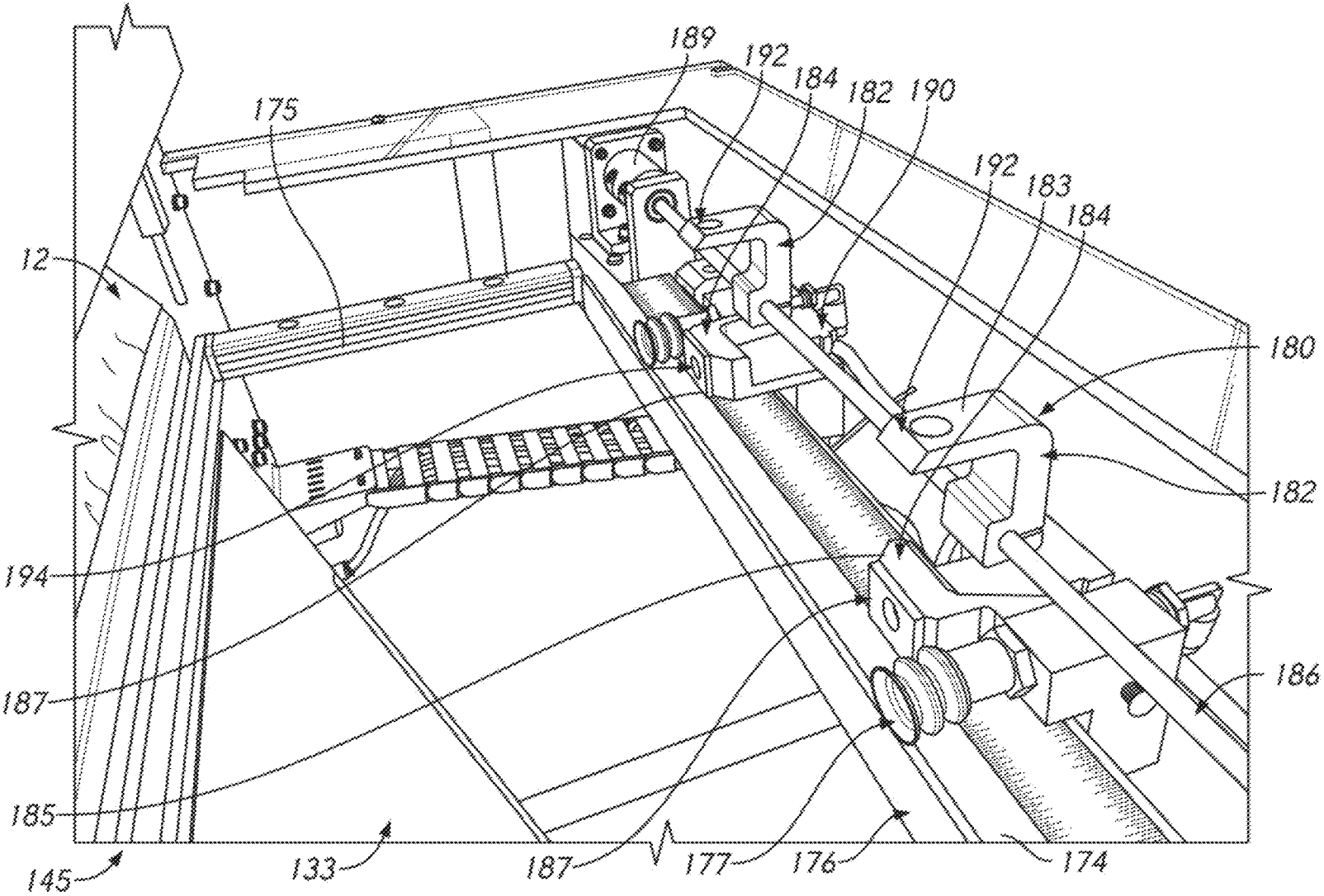
FIG. 6 is another view of the bag loading assembly in FIG. 5.
Figure 9:
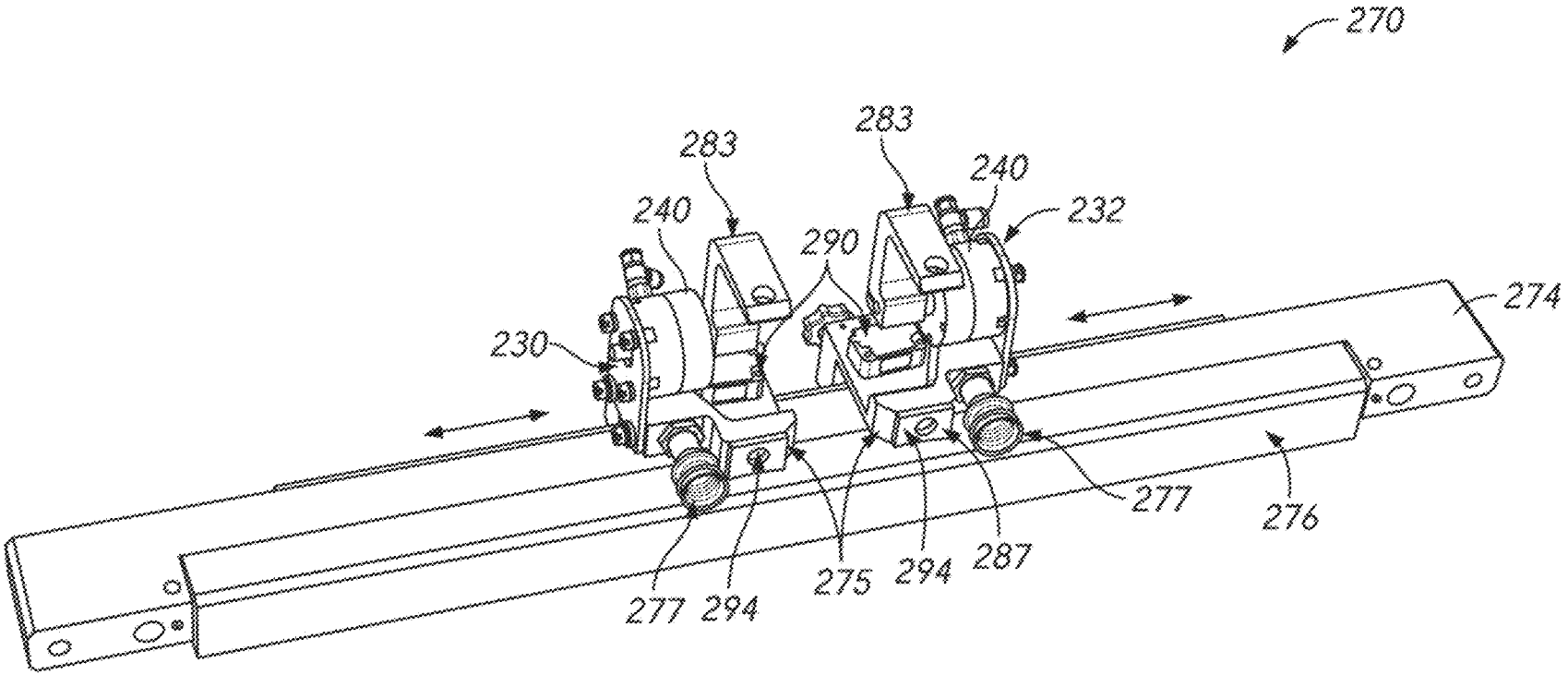
Figure 10:
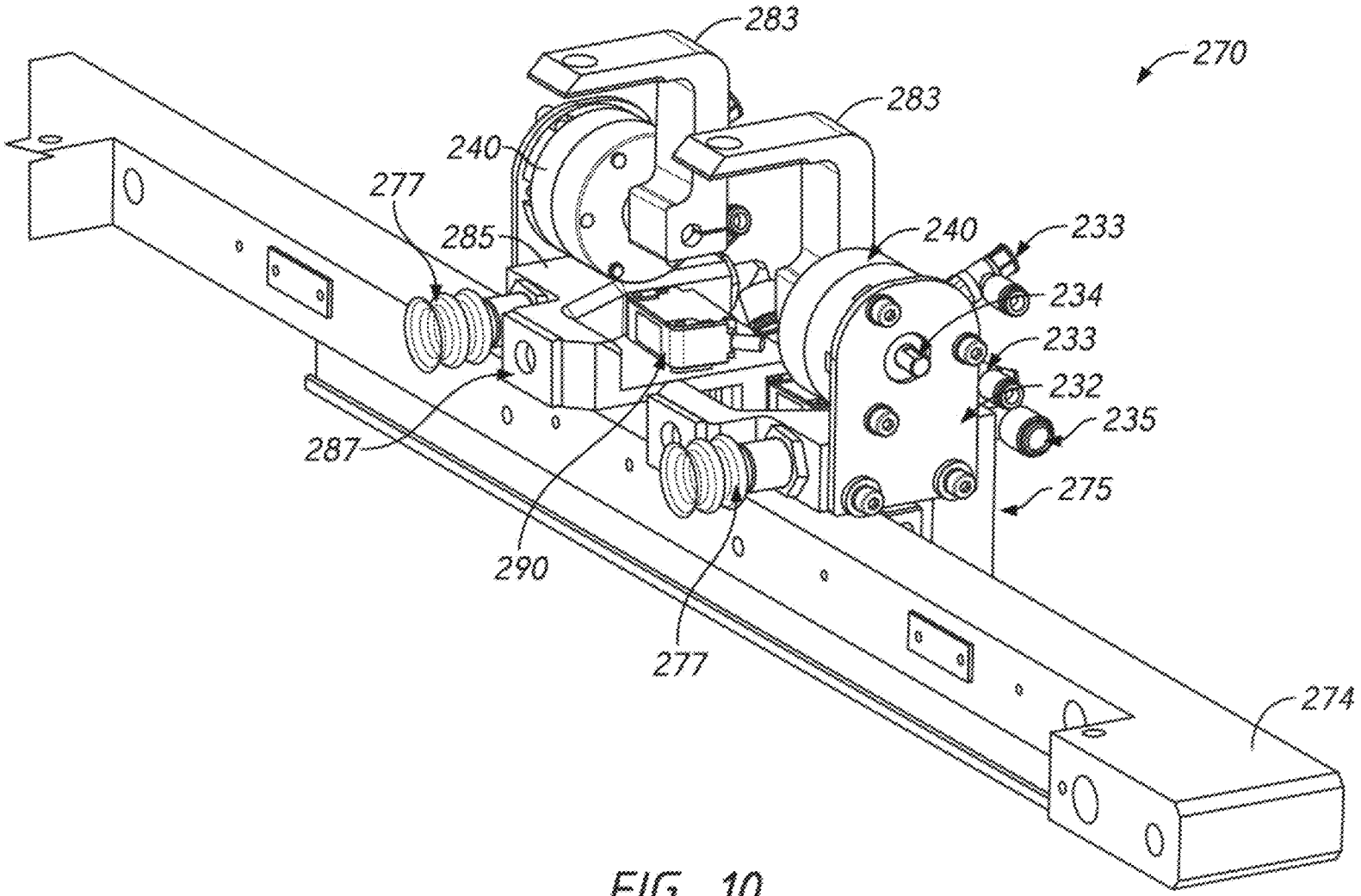
Figure 11:
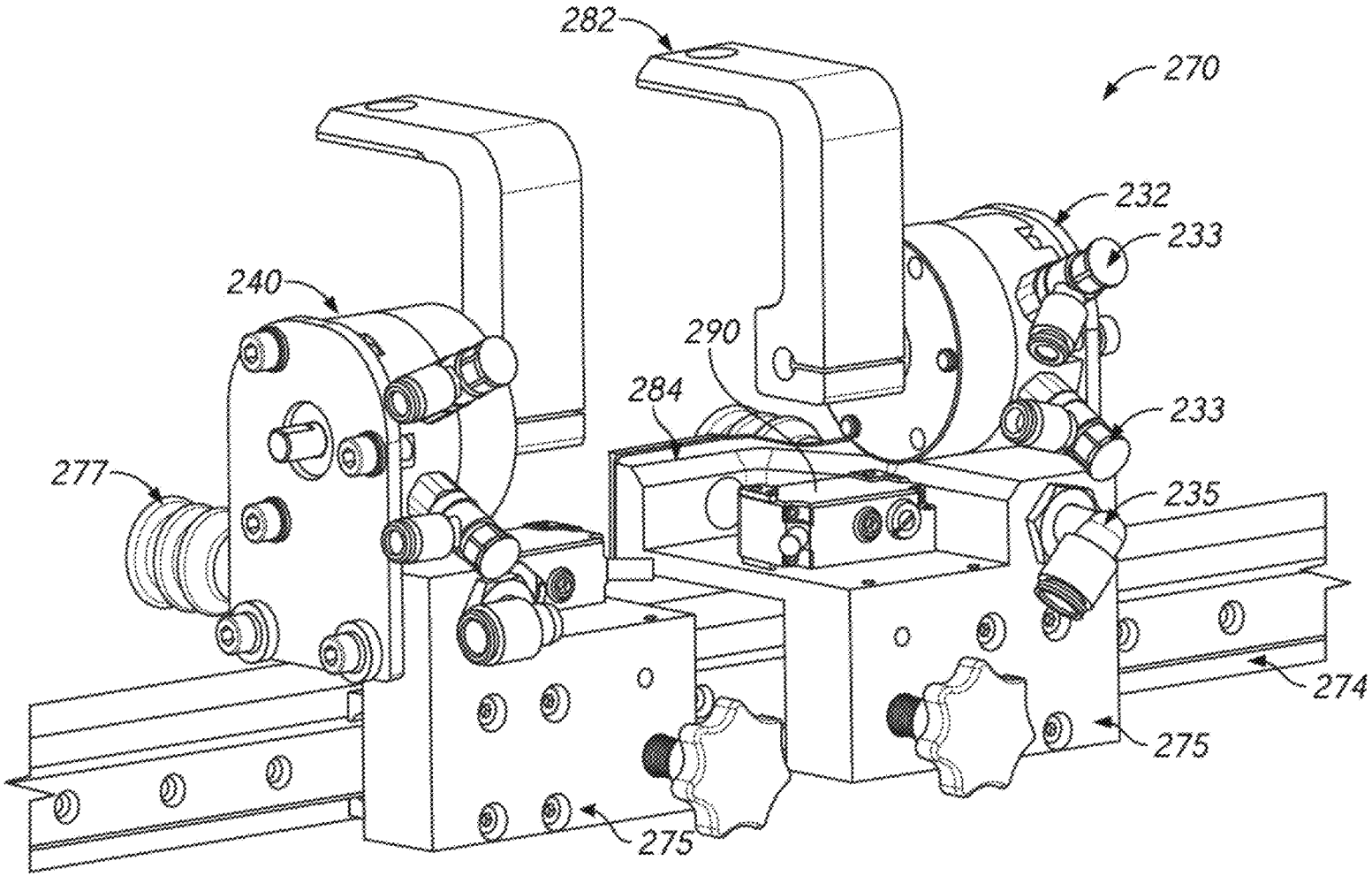

Referring now also to FIGS. 5-15, further aspects of bag manipulation structures of a bagging machine are described. FIGS. 5 and 6 show views of a bag opening assembly 170 operatively associated with bag loading area 133 of a bagging machine. The bag opening assembly 170 may be provided in a product bagging assembly, such as the product bagging assembly 22 shown in FIGS. 1 and 2. FIGS. 9-11 show views of a bag opening assembly 270 and components thereof, in accordance with further examples of the present disclosure.

In FIG. 5, a bag loading assembly 122 of a bagging machine is shown during use with a portion of the web that defines an individual bag 11 provided in the bagging area 133 and the bag opening assembly 170 engaging the bag 11 to hold the bag open, thus controlling a shape of the opening or mouth 17 of bag 11. In this view, the opening 17 is generally trapezoidal in shape, however in other scenarios a different shape of the opening 17 may be achieved depending on the control parameters, sequence, and arrangement of the film control elements 160 utilized in a given scenario. For example, in other embodiments, the components and operation of the bag loading assembly may be configured such that the mouth or opening 17 of the individual bags, as they are opened, is generally rectangular in shape. In FIG. 6, the bagging area 133 is shown from a different viewing angle and with the film removed to better show certain components of the bag opening assembly 170. The bag opening assembly 170 may be used in place of the bag opening assembly 70 in a bagging machine according to the present disclosure.

As shown in FIGS. 5 and 6, the bag opening assembly 170 is movably coupled to the chassis 34 by a carriage 172, which in operation reciprocates (back and forth) in relation to the chassis. The carriage 172 includes side members 175 that move (e.g., slide) toward and away from the bag inlet 144. The carriage 172 supports a cross member or pressure plate 174 which extends between the two side members 175 located at the opposite sides of the carriage. The pressure plate 174 is thus movably supported by the carriage 172 and moves back and forth, along the closing and opening directions 75 and 78 to cause the pressure plate 174 to move toward and away from the bag inlet 144, respectively. The individual ones of the side members 175 may be implemented using any suitable arrangement of components such as sliders, rollers or bearings, including but not limited to air bearings, supported on a suitable track, or using a suitable telescoping member such as an air cylinder or other type or linear actuator that enable the reciprocation of the pressure plate 174 relative to the bag holding and sealing area 145. Alternatively, instead of the carriage 172 moving with respect to the frame, a pair of rails may be fixed to the frame, e.g. at the location of the side member 175, and the pressure plate 174 configured to slide along the rails. Any suitable configuration for enabling the relative movement of the pressure plate 174, e.g., toward (along closing direction 75) and away from (along opening directions 78) the inlet 144 and the bag holding and sealing area 145 may be used. The carriage 172 or pressure plate 174 may be operatively associated with one or more actuators (not shown in this view), to drive the movement of the pressure plate 174 toward and away from the inlet 144 and the bag holding and sealing area 145.

As previously described, the bag inlet 144 may include a slot or channel formed in a wall structure of the machine that separates the supply handling assembly from the bag loading assembly. In other examples, where no dividing wall structure is used, the inlet may by provided by a suitably shaped entry portion into the bagging area along the web travel path, which may include leading support surface(s) (e.g., one or more rollers or static surfaces) that guide the web to the bag holding and sealing area 145. As described, the pressure plate 174 is configured to apply a force along a transverse dimension of the web to assist with sealing of the bag 11. The pressure plate 174 may include a bumper 176 (e.g., made from a resiliently deformable material such as an elastomer or any other suitable material) on a side of the pressure plate 174 facing the bag holding and sealing area 145. The bumper 176 is positioned on the pressure plate 174 such that it aligns with a sealing element 148 provided in the bag holding and sealing area 145. The bagging area may include trailing support surface(s) for guiding the packaged bag out of the product outlet.

In accordance with the principles of the present disclosure, the bag loading assembly 170 may include a plurality of film-control or bag-handling elements 160. Each of the film-control elements 160 may be an integrated sub-assembly or unit configured to control or handle a portion of the film that defines an individual bag at a given location around the pass through opening to effect the opening and/or closing of the bag. In the illustrated example, the bag loading assembly 170 includes front and rear film-control elements for controlling both the front and rear side of the bag opening 17. However, in some embodiments, the rear film-control elements may be omitted and the opening and closing of the bag may be achieved by only manipulating the front side of the bag opening 17. The rear film-control elements are arranged near the inlet 144 and bag holding and sealing area 145 to control the rear side of the bag opening, while the front film-control elements are provided on the moveable pressure plate 174 to effect opening and closing of the bag.

Referring to FIGS. 5 and 6, the bag opening assembly 170 includes front film-control elements 163 moveably supported on the chassis of the bagging machine. For example, the front film-control elements 163 may be supported on a pressure plate 174 and/or carriage 172, which are movable in relation to the chassis. In this example, a pair of front film-control element 163 are provided, however in other examples, a different number of (e.g., a single) front film-control elements 163 may be used. Each front film-control element 163 includes a gripper assembly 180 (see FIG. 6) configured to grip, between first and second gripper portions 182 and 184 of the assembly 180, a front side of the bag 11 near the opening 17. The second gripper portion 184 are configured to remain in a fixed position with respect to the pressure plate 174 during opening and closing of the bag, while the first gripper portions actuate in order to grip the bag. The first gripper portion 182 is moveably coupled to the second gripper portion 184 and are thus interchangeably referred to, respectively, as moveable finger 182 and fixed finger 184. In this embodiment, the moveable finger is rotated in relation to the fixed finger 184 via an electric actuator 189, however in other embodiments other suitable actuators, such as a hydraulic or an electro-hydraulic actuator may be used for the actuator 189. In this example, the moveable finer 182 is L-shaped finger 183 configured to pivot about an axis proximate to the base of one of the legs of the L shape, while and the fixed finger 184 is implemented as a stationary block 185. The finger 183 is pivotally coupled to the pressure plate 174 via the shaft 186 and rotationally driven about the axis of the shaft by the actuator 189. During operation, the finger 183 rotates in a direction toward the bag inlet 144 and down toward the fixed block 185 to cause the fingers (also referred to as grippers) to close onto one another for gripping the bag 11. In this example, the fingers of both of the front gripper assemblies are on the same shaft 186 and can thus be driven by a single actuator 189. In other examples, e.g., as shown in FIG. 7, the individual fingers may be driven by separate actuators. Referring back to the example in FIG. 6, the common shaft 186 may be a cylindrical shaft and the fingers 183 may be mounted thereto (e.g., via setscrews). In other examples, a non-cylindrical (e.g., a rectangular, triangular, pentagonal or hexagonal) drive rod may be used, and the fingers may be keyed to the transverse cross-section of the drive rod, such that they are aligned to a same open position and effect the same closing arc to enable both of the gripping assemblies to operate in synchrony when gripping and opening a bag.

The position of the individual gripper assemblies 180, while the machine is not operating on a bag, may be adjustable. For example, the individual gripper assemblies 180 may be movably mounted, in some cases as individual units, to the pressure plate 174 to allow them to be repositioned to any desired position along the length of the pressure plate 174 thus providing varying transverse gripping width with respect to the web for varying sizes of pass through openings. In the example in FIG. 6, the transverse position of the first gripper portion 182 may be adjusted by releasing a setscrew of finger 183 and sliding the finger to a new desired position along the shaft 186 and then tightening the setscrew again to secure the finger 183 to the new position. The block 185 may be repositioned by operating the knobs 165 or another suitable mechanism, which fix the position of the fixed fingers with respect to the pressure plate. In some embodiments, the moveable and fixed fingers 182 and 184 may joined to one another into an integrated unit such that repositioning of one of the fingers repositions the other (e.g., as in the example in FIG. 7). In further examples, actuators rather than manual adjustment may be used to reposition the individual fingers 182 and 184 of the entire gripper assembly as a unit. One or both of the contact surfaces of the gripper portions may be provided with a resiliently deformable material (e.g., an elastomer pad 187) for improving the traction and holding ability of the individual gripper assemblies 180. Each gripper assembly may additionally include a vacuum assist device 177 (e.g., a suction end-effector and associated hydraulic components) to aid in the opening of the bag (e.g., to initiate the opening of the bag against static or station that may be present at between the upper and lower layers of the film plies in a tightly rolled or fan folded web configuration). Alternatively, one or more air assist devices or blowers (e.g., air knife 43) may be used in place of or together with the vacuum assist devices 177 to initiate the opening of the bag, the initial opening of the bag serving to provide a sufficiently sized initial opening to enable the fingers 182 and 184, as well rear fingers, to engage the bag.

As illustrated, rear film-control elements or fingers 161 may be provided proximate the rear side of the bag opening 17 to keep the rear edge of the film at the bag opening generally taut while the bag opening assembly 170 opens and closes the bag. A variety of suitable rear film-control elements may be used (e.g., such as pivotable fingers as in the example in FIG. 2 or others). In this example, the rear fingers 161 are implemented as a pair of generally straight elongate members 152 extending transversely across the bag inlet 144—that is, generally aligned with the longitudinal direction of the web 12 as it passes through the bag inlet 144. Each of the rear fingers 161 is moveable along a translation direction 102 and at least a portion of each rear finger 161 is moveable in an extension direction 104. To effect the translation motion along the direction 102, the individual fingers 161 may be slidably supported on a rail (not shown), e.g., coupled to the frame of the bagging machine above the bag inlet 144 and extending along the direction 102. An actuator (e.g., electric or hydraulic) may be associated with the pair or with each individual finger 161 to drive the translating motion of the fingers (e.g., towards and away from center of the inlet 144). The same or additional one or more actuators may effect the transverse or extension/retraction motion of the fingers 161. The extension/retraction motion repositions at least a portion of each finger 161 at different transverse positions across the bag inlet to allow the fingers 161 to engage and release the bag opening 17. As will be further described, each finger 161 (or portion thereof) moves in a direction transverse to the bag inlet 144 between an extended position in which the rear finger 161 is extended into the opening of the bag, and a retracted position in which the rear finger 161 does not extend into the opening of the bag.

In the illustrated example, the individual rear fingers 161 are implemented as telescoping members 152 having a fixed base portion 154 and an extendable or telescoping tip portion 156. The base portions 154 are driven by one or more actuators in the translation direction 102, and the tip portions 156 are driven by the same or an additional actuator in the extension/retraction direction 104. In some embodiments, air pressure may be used to extend and/or translate the fingers. In other embodiments, the first fingers may not be telescoping members and may instead translate in the direction 104 to effect the extension into and retraction from the bag opening. As described, the fingers 161 are operably associated with the one or more actuators to move in symmetric opposition to one another. That is, when one of the fingers 161 is moving in one direction (e.g., a direction toward the center of the bag inlet 144) the other finger 161 is moving in the opposite direction to move toward the center of the bag inlet 144, and vice versa the two fingers move synchronously in opposite directions to move away from center of the bag inlet 144.

In accordance with the principles of the present disclosure, the bag loading assembly may be operatively associated with a bag open verification system configured to verify that the bag has been successfully engaged by the front film-control elements. In some examples, one or more sensors may be operatively arranged in relation to each of the front film-control elements to acquire sensor data for verifying that the bag has been successfully gripped by the film-control element. The one or more sensors may be in communication with a control system (see e.g. FIG. 12), which controls the operational sequence for opening, loading, and sealing the bags. As described further below, the control system may receive sensor data from the one or more sensors and generate command signals for controlling the operation of actuation components, such as the motors, actuators, or other drive components that move conveyors, spindle, or other film advancing components, as well as the pressure plate, film control elements, and/or a robot operator, in instances of automated product loading. The control system may additionally or alternatively generate fault signals for displaying and/or otherwise transmitting error messages.

Figure 7B:
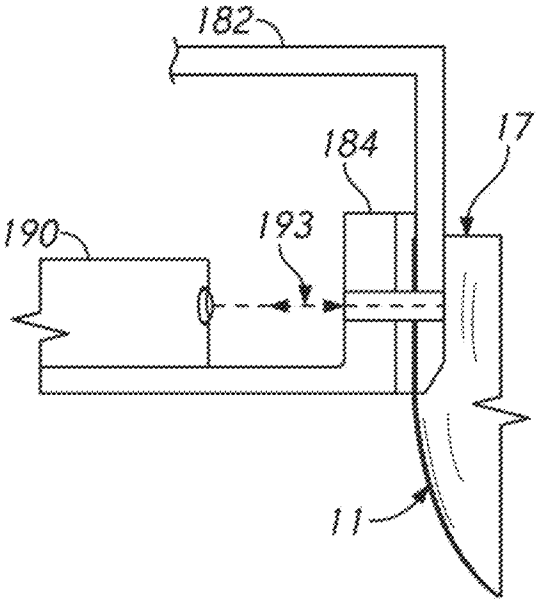
FIGS. 7A and 7B illustrate aspects of the operation of a bag verification system.
Figure 7A:
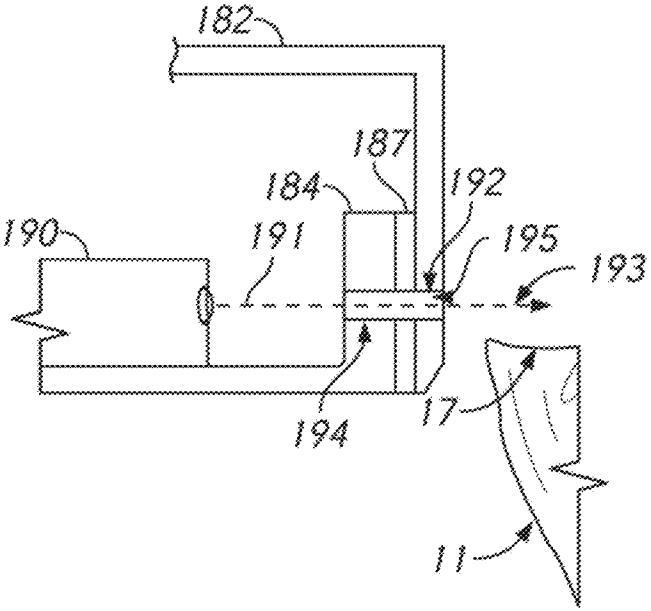
Figure 8:
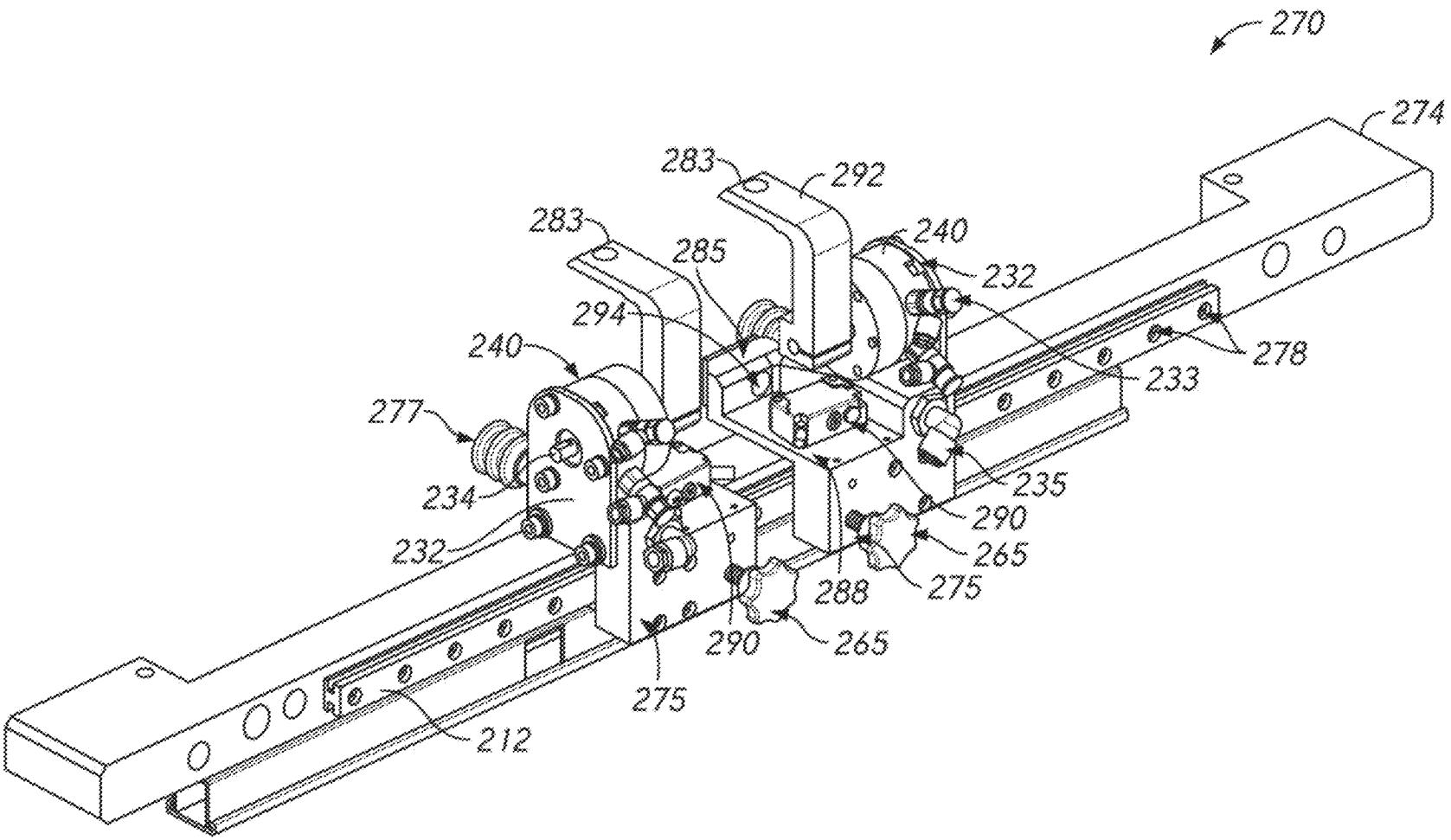
FIGS. 8-11 are views of a bag opening assembly in accordance with further examples of the present disclosure.

Referring to the example in FIGS. 5 and 6, and also referring to the illustrations in FIGS. 7A and 7B, the bag open assembly includes at least one sensor (e.g., an electro-optical sensor, a proximity or other type of electromagnetic sensor, etc.) arranged in cooperation with each gripper assembly to verify the successful gripping of the bag by the gripper assembly. An example of a suitable optical sensor includes the PZ-G101EN photo optic sensor manufactured by the Keyence Corporation, although many other similar types of sensors may also be used. In this embodiment, the sensor 190 is fixed in relation to the assembly 180 and dedicated to sensing the presence of the film between the gripper portions of that assembly. In embodiments, the sensor(s) 190 may positioned in any suitable arrangement to allow the sensor to look through the aligned apertures of the two fingers to detect the presence or absence of a material between the fingers and to generate corresponding signals. The fixed and movable gripper portions 182 and 184, respectively, each include a respective aperture 192 and 194, which are positions such that they align, at least partially, with one another to form a through-passage 195, when the gripper assembly is in the closed configuration. The sensor 190 is arranged in front of the closed grippers and facing back toward the bagging area in a position, which aligns the line of sight 191 of the sensor 190 with the through-passage 195. For example, in the case of an optical sensor, an optical beam 193 transmitted along the line of sight 191. Due to the presence of the through-passage 195, in the absence of the bag 11 between the gripper portions 182 and 184, the beam will travel substantially uninterrupted through the passage 195, as shown in FIG. 8A, dissipating or its intensity attenuating with distance without any significant reflections returning to the sensor 190. In contrast, when the film that defines the front side of the bag 11 is present between the gripper portions 182 and 184, the optical beam 193 is interrupted. The beam reflection is detected by the sensor 190, which generates a responsive signal(s) indicative of the presence of the film between the grippers. In other examples, signals indicative of the absence of the film/bag may be generated. These signals are coupled to the control system to determine, whether a bag is present between the grippers at the appropriate times in the bagging sequence which may consequently control the operation of the machine depending upon whether bag is determined to be present or absent. Other types of sensors may be used such as an electromagnetic sensor that detects a disruption in the field due to the presence of the film, or an optical interrupt sensor assembly with the transmit and receive portions provided on the respective grippers of each gripper unit. In some examples, the sensors may additionally and optionally be used to detect when the pressure plate has advanced sufficiently toward the bag to activate certain components, e.g., to activate the vacuum assist devices. As described, the individual sensors are fixed in relation to at least one and preferably both fingers of the respective individual gripper assembly, thus advantageously providing an integrated unit which can be moved (repositioned) to another location on the pressure plate without changing the relationship between sensor and fingers. This may avoid having to reposition, align and recalibrate the sensors each time the gripper assemblies are positionally adjusted.

FIGS. 8-11 show views of a bag open assembly 270 in accordance with further examples herein. The bag open assembly 270 includes one or more similar components as and operates in a similar manner to the bag open assembly 170. For example, the bag open assembly 270 includes a cross bar or pressure plate 274, which is movably supported on the frame of the bagging machine to allow it to move back and forth in the opening and closing directions. The pressure plate 270 supports a pair of front film-control elements 263, which are coupled to the pressure plate via a rail 212 to allow for repositioning of the individual front film-control elements 263. A bumper 276 (see FIG. 9) is provided on the inward facing side of the pressure plate.

The individual front film-control assemblies 263 are implemented as gripper assemblies 280 similar to those in the example in FIGS. 5-6, with a difference being that here the pivotal motion of the gripper portions 283 is effected by individual actuators 289 (in this example rotary hydraulic actuators, but equivalently rotary electric actuator may also be used), as opposed to a single actuator driving both gripper assemblies. As illustrated, the individual gripper assemblies may optionally include integrated vacuum assist devices 277. The hydraulic connectors 233 and 235 for the actuators 289 and vacuum assist device 277, respectively, are provided on the operator side of the assembly. Each gripper assembly is an integral unit mounted, via a mount 275, to the pressure plate, and more specifically to rail 212. The gripper assemblies are repositionable along the rail 212 by operating the knobs 265. In some embodiments, the rail may include positioning detents 278 defining a discrete number of positions available for the gripper assemblies. In other examples, the knobs may tighten against the rail (for example as setscrews) to position the gripper assemblies at virtually any location along the rail 212. The mount 275, which may be formed as a unitary component with the fixed gripper portion 285, includes a ledge 288 that supports the sensor 290. The ledge 188 is configured to position and support the sensor 290 such that the line of sight of the sensor 290 aligns with the sensor apertures 292, 294 of the gripper portions. The moveable gripper portion 283 is mounted, via a bracket 232, above the mount 275 and positioned such that the apertures 292, 294 align at least partially to form the through passage (see e.g., FIGS. 7A and 7B). Each moveable gripper portion 283 is rotatably supported on a shaft 234 of the respective actuator 240 such that each moveable gripper is rotatable about the shaft 234 in a rotational direction 235. The respective actuators 240 are fixed to the respective mounts 275 via a respective bracket 232, the respective moveable finger and actuators thereby forming an integral unit with the respective fixed finger and sensor. The operation of the sensor 290 is the same as described above with respect to FIGS. 5-7. As described, the individual gripper assemblies 280 are provided as integral units, each of which (and its associated components, including its fixed and moveable finger and associated sensor) are moveable along the bar 274 as a unit, e.g. by operation of the knobs 265. By providing each individual gripper assembly with a dedicated bag-present sensor that remains in a fixed position to the assembly even when the assembly is repositioned, a more user-friendly bag loading assembly may be achieved by eliminating the need for re-alignment, set up or calibration steps whenever the gripper assemblies are repositioned to accommodate a different pass-through size. Any of the bag open assemblies described herein may be interchangeably used in any bagging machine according to any of the embodiments herein.

Figure 12:
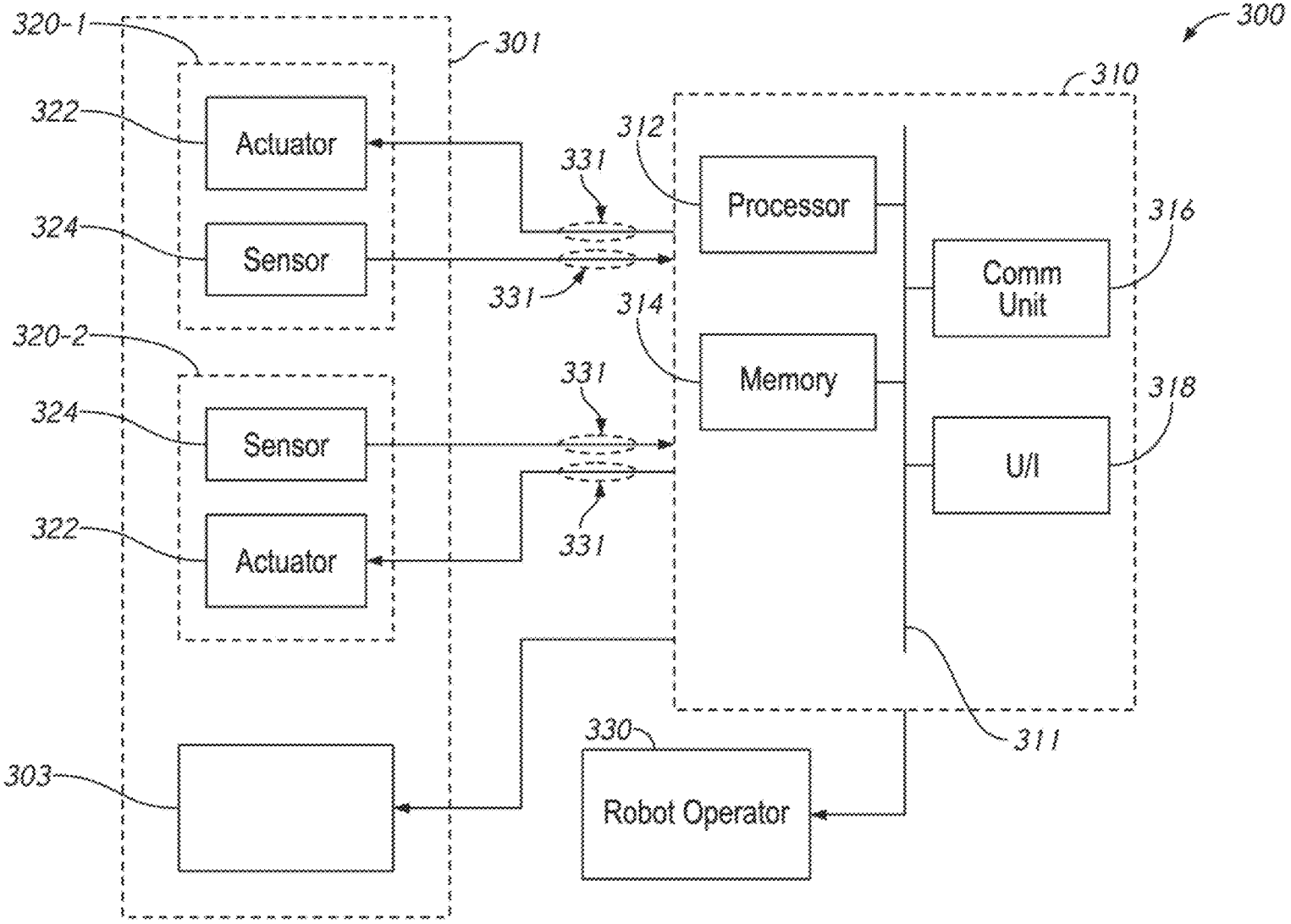
FIG. 12 is a block diagram of a control system for a bagging machine in accordance with the presence disclosure.
Figure 13B:
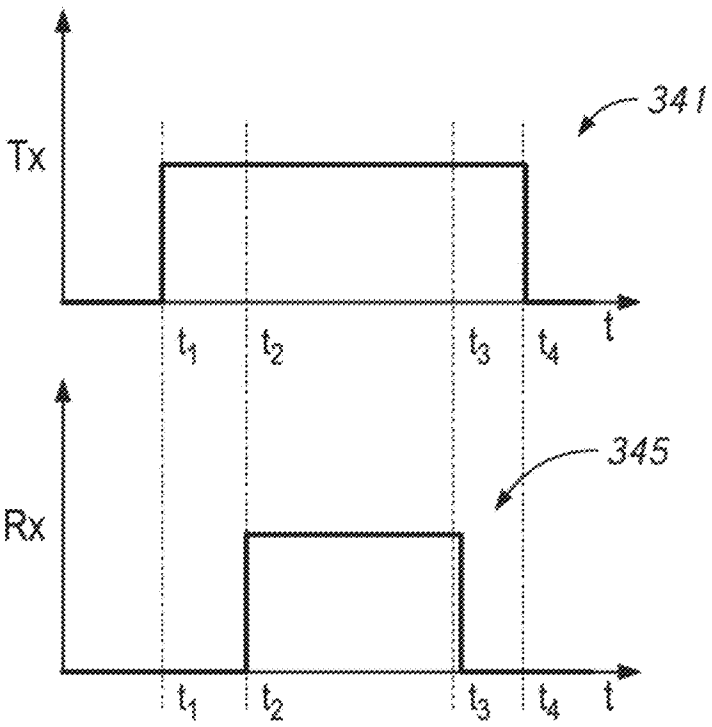
FIGS. 13A and 13B are signal diagrams of transmit and receive signals of a bag-open verification sensor.
Figure 13A:
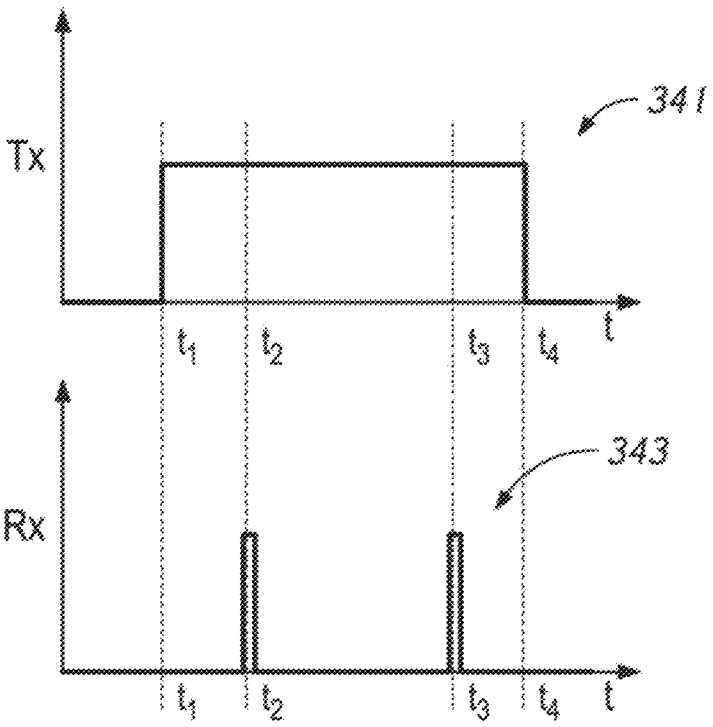

FIG. 12 shows a block diagram of a control system 310 associated with a bagging machine 300 of the present disclosure, the operation of which will be described further with reference to the signal diagrams in FIGS. 13A-B, the flow diagram in FIG. 14 and the operational sequence illustrated in FIGS. 15A-I showing snapshots in time of the bagging machine while performing a product bagging or loading sequence. The control system 310 may include a processor 312 and memory 314. The processor 312 and memory 314 may be communicatively coupled to one another (e.g., via a signal or data bus 311) and/or to other components external to the control system 310 (e.g., the sensors 324 and actuators 324 of the individual gripper assemblies 320-1, 320-2, and/or other components (e.g., actuator 303, robot operator 330) controlled by the control system 310. In some embodiments, the control system 310 may additionally optionally include one or more communication devices 316 (such as wireless communication device like Bluetooth, Wi-Fi, near or far field communication devices) for wirelessly communicating with controlled components and/or transmitting data to an external computer. The control system 310 may be associated with a user interface 318, which may include any number of suitable user interface devices such as a passive display, touch-sensitive display, keyboard, touchpad and/or other output and input devices, for providing information and instructions to the user, displaying fault messages, and/or receiving user input such as process step selections and/or confirmatory inputs. The memory 314 may executable instructions, such as for effecting the steps and sequences associated with the bag loading process and/or for effecting a machine-user interface between the control system 310 and the operator (in the case of a human operator). In some embodiments, the control system 310 or at last some of the components thereof (e.g., the processor 312) may be physically co-located with the bagging machine 300, for example it may be integrated with and be part of the machine 100. For example, the components and functionality of the control system 310 may be implemented in a microcontroller unit (MCU) which may be embedded in the bagging machine 300. In some embodiments, the control system 310 or one or more components thereof (e.g., the U/I 318) may not be physically co-located but may instead be remotely located from the bagging machine 300. In some such examples, alerts or other information may be provided to an operator (e.g., a human user or robot operator) in real time even when the operator is not physically near the bagging machine 300.

As illustrated, the processor 312 is in communication with the sensor 324 of each of the individual gripper assemblies 320-1, 320-2. The processor 312 receives sensor data or signals 331 (e.g., as shown and described with reference to FIGS. 13A and 13B) from the individual sensors 324 and transmits control signals 333 to the actuator(s) 322 driving the movement of the moveable gripper portions of the gripper assemblies 320-1, 320-2. The processor 312 may communicate with the actuator(s) 303 controlling the movement of the pressure plate along the bag opening/closing direction and/or any other actuation components (e.g., the motor controlling advancement/retraction of the web toward and away from the bag inlet, hydraulic actuators and/or air supply for the vacuum assist devices or air knife, rear film-control element actuation, etc.). FIGS. 13A and 13B shows transmit (Tx) and receive (Rx) signals that may be generated, in accordance with one example, by the individual sensors 322 as a function of time. In other examples, different set of signals may be generated and transmitted from the sensor, depending upon the type of sensors and arrangement used. Specifically, FIG. 13A shows transmit and receive signals associated with a failed grip of a bag, while FIG. 13B shows transmit and receive signals associated with a successful grip by a gripping assembly (e.g., 320-1, 320-2). As shown in both sets of plots, the sensor may be activated at a time $t_1$, which may occur responsive to, concurrently with, or shortly after the activation of the activation of the vacuum assist devices, or may be based upon the position of the pressure plate along the opening/closing direction 52 (e.g., at any of the times illustrated in FIGS. 15A-15C). Upon activation of the sensor, the transmit signal Tx increases (as indicated by signal trace or profile 341) from a null (low voltage) value to a non-null (high voltage) value to indicate and an optical beam is being transmitted. It will be understood that high frequency optical beam pulses, as opposed to a continuous beam, may equivalently be transmitted, the envelope of which may resemble the signal profiles 341. The receive signal, as shown by signal trace 343 briefly transitions to a high value at time $t_2$, due to the temporary blockage of the through passage by the fingers during the closing of the gripper assembly. In the case of the failed grip attempt, the receive signal Rx transitions back to a low value shortly after $t_2$ due to the absence of the film between the grippers. Similarly, at time $t_3$, the receive signal (trace 343) again briefly transitions to a high value at time $t_3$, due to the temporary blockage of the through passage by the fingers during the re-opening of the gripper assembly and then back to a low value once the fingers have been opened. In contrast, in the successful grip scenario (FIG. 13B), upon the closing of the gripper assembly (at $t_2$) shortly after the activation of the sensor (at $t_1$), the receive signal transitions to a high value and remains at the high value until the opening of the gripper assembly (at time $t_3$) indicating that for the entire period between the closing and opening of the grippers, the film material was present between the grippers. As with the previous scenario, shortly after the grippers are opened, the sensor may be deactivated with the transmit signal trace going to low voltage (e.g., zero) at time $t_4$. As such, the processor 312 may be configured to change the sequence of operation of the bag loading assembly based upon the profile of the signals received from the gripper assembly sensors 324.

Figure 14:
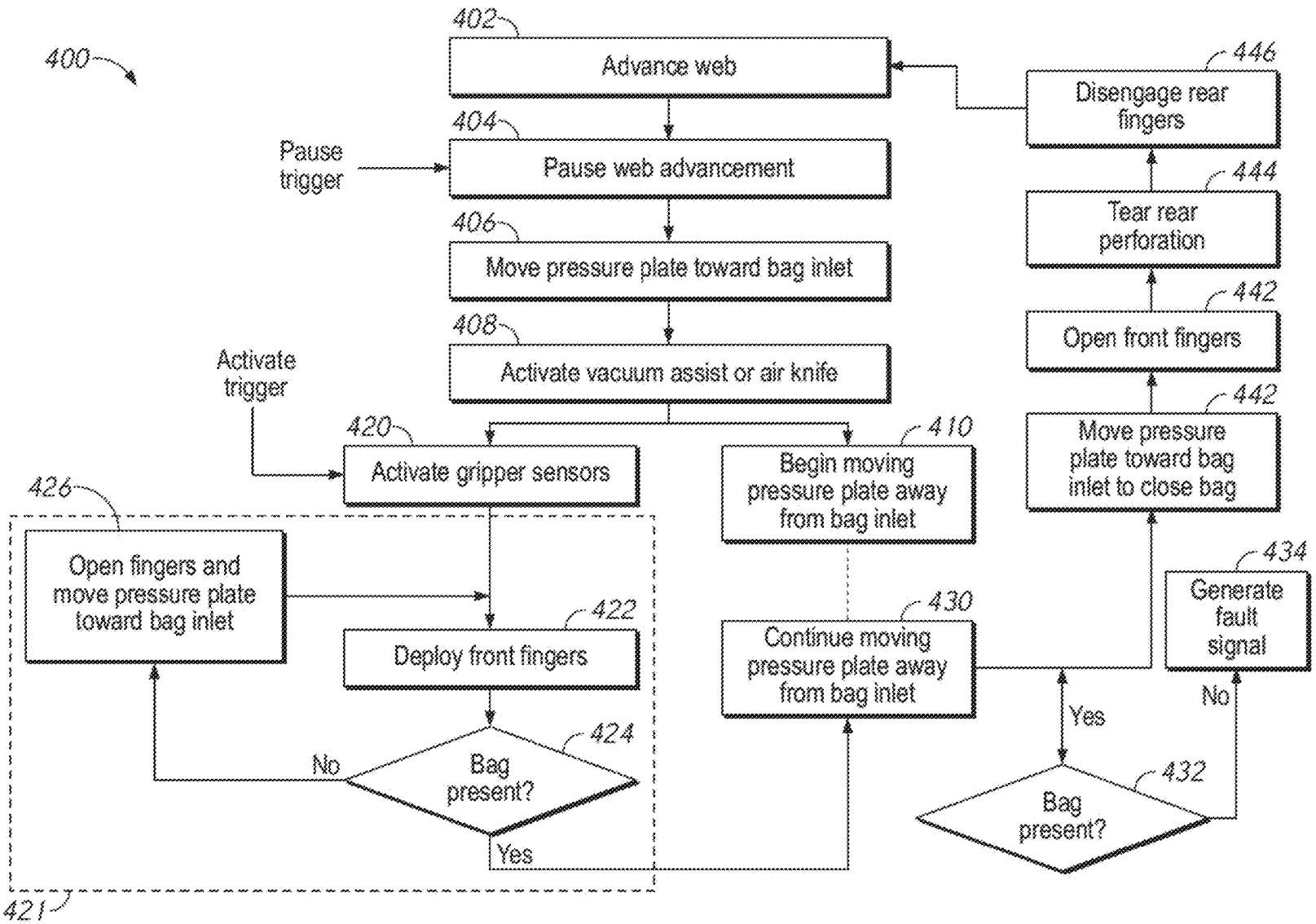
FIG. 14 is a flow diagram of an example process of operating a bag loading assembly.

FIG. 14 shows a flow diagram of an example process 400, one or more of the steps of which may be implemented in the control system (e.g., processor 312) in accordance with the principles herein. The process begins by advancing the web, as shown in block 402, until the web is positioned at the inlet such that the opening of the bag is just slightly above the bag sealing area. The advancement of the web is then paused, as shown in block 404, the pausing being based upon predetermined or machine-vision triggered timing. Once the web is appropriately positioned with respect to the bag inlet and the sealing area, the pressure plate is advanced toward the bag inlet (block 406) and thus toward the bag, until the pressure plate is just next to the bag (or in some case the pressure place and/or vacuum assist devices are contact with the bag). The optional vacuum assist devices or air knife may be activate (at block 408) or in some cases, the air knife may continuously operate (blowing air tangentially to the web) during the opening, closing and advancement of the web. The process 400 may continue with the pressure plate beginning to move backward, as shown in block 410. Also, the gripper sensor may be activate, as shown in block 420, and the front fingers are deployed, as shown in block 422 to grip the bag. As described, the activation of the sensor may occur at a different timing, such as with or prior to activation of the vacuum assist devices or air knife. The activation may be triggered based upon a predetermined time threshold in the sequence or it may be triggered by machine-vision (e.g., when machine vision determined that the gripper assemblies are in a suitable position with respect to the bag and/or an appropriate location in the opening sequence). This opening sequence is associated with a bag present verification sequence 421, during which the control system of the bagging machine receives sensor data and determines if the bag has been successfully gripped (i.e., whether the bag/film is present between the fingers of the gripping assembly). If it is determined that a bag is not present between the fingers, the process 400 moves to block 426 where the fingers are re-opened and the pressure plate is moved back toward the bag inlet to attempt again to grip the bag. The bag present verification process 421 may be performed continuously or periodically during the opening of the bag. That is, the control system may, in real-time, receive sensor data during an opening sequence, where the sensor data indicates whether a bag is present between the grippers. Based on the sensor data (e.g., based upon whether a bag is determined to be present or not between the grippers) an operational sequence of the bagging machine (e.g., the opening sequence) may be modified, such as to pause and/or re-start a bag opening sequence, generate alerts and/or log fault messages. As described, the operation of the bag opening assembly, e.g., actuation of the pressure plate and/or actuation of the grippers, such as to interrupt the bag opening, re-open the fingers, reposition the pressure plate and fingers at a starting position, may be controlled based on the information obtained from the sensor(s). The bag present verification process may be performed with respect to each individual gripper assembly and thus a failed grip by any one of a plurality of gripper assemblies may result in returning to block 426 to re-attempt the opening of the bag. Once the bag is opened, the sensor(s) may continue to collect sensor data, as shown in block 432, e.g., to ensure that the bag remains securely gripped by the grippers during loading and closing of the bag. In some embodiments, and as shown in block 434, upon indication that a bag is not present at any time before the closing of the bag (e.g., before indication that the bag is sealed), the control system may generate a fault signal (at block 434), which may cause operation of the machine to be paused and/or a fault message to be transmitted or logged in the system. In some examples, block 434 may include generation of control signals to cease the operation of a robot operator. In some examples, block 434 may alternatively or additionally include generating a fault message for display or for providing any other type of suitable alarm to an operator. If not fault (e.g., bag not present) is detected during the product loading stage, the process 400 continues to blocks 440-446, during which the pressure plate is moved toward the bag inlet to close the bag, the fingers are opened to release the front side of the opening, the rear perforations are torn and the rear fingers are disengaged to release the bag to the bag outlet. The bag opening, loading, and closing sequence is then repeated by the process returning to block 402.

Figure 15A:
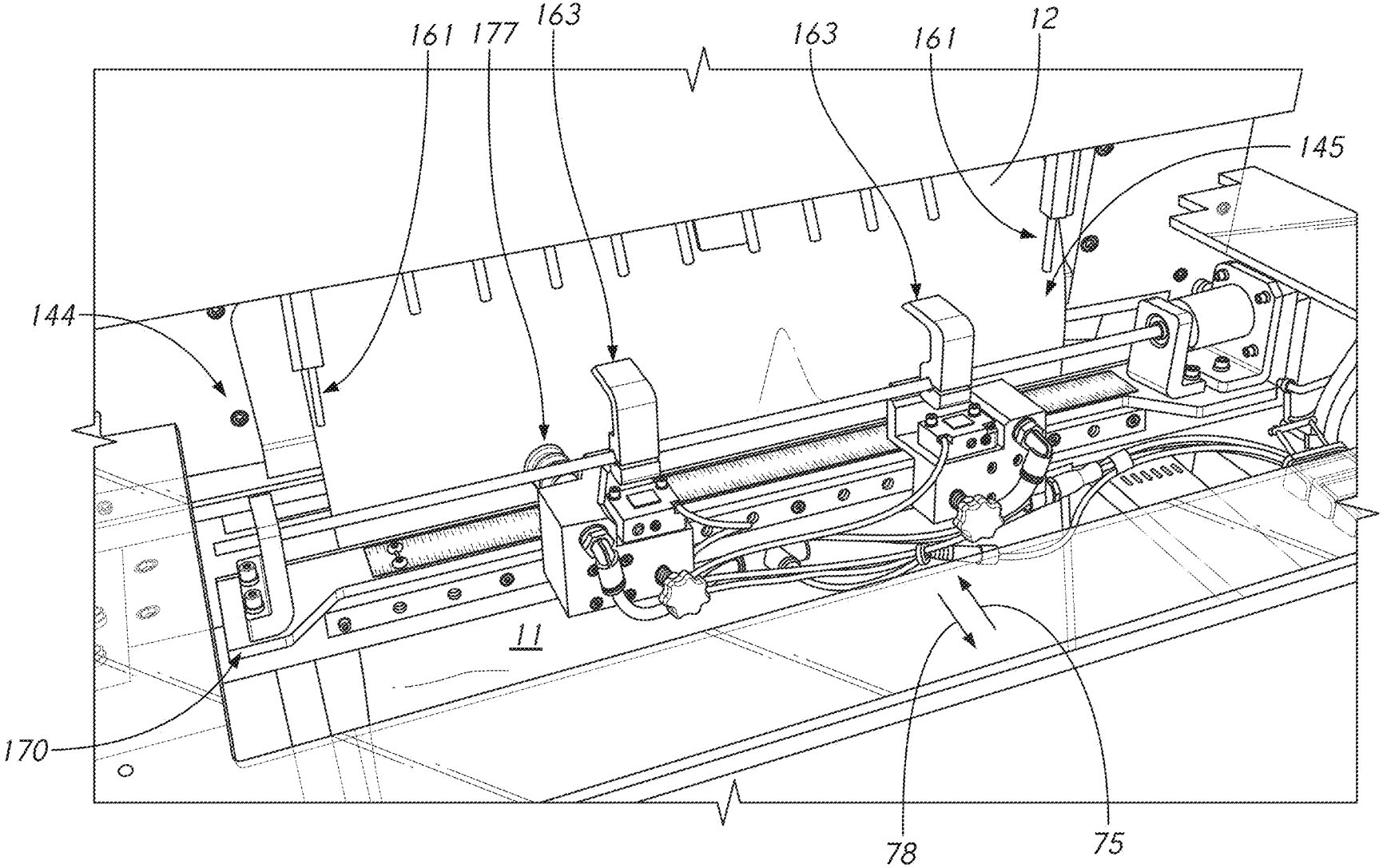
Figure 15B:
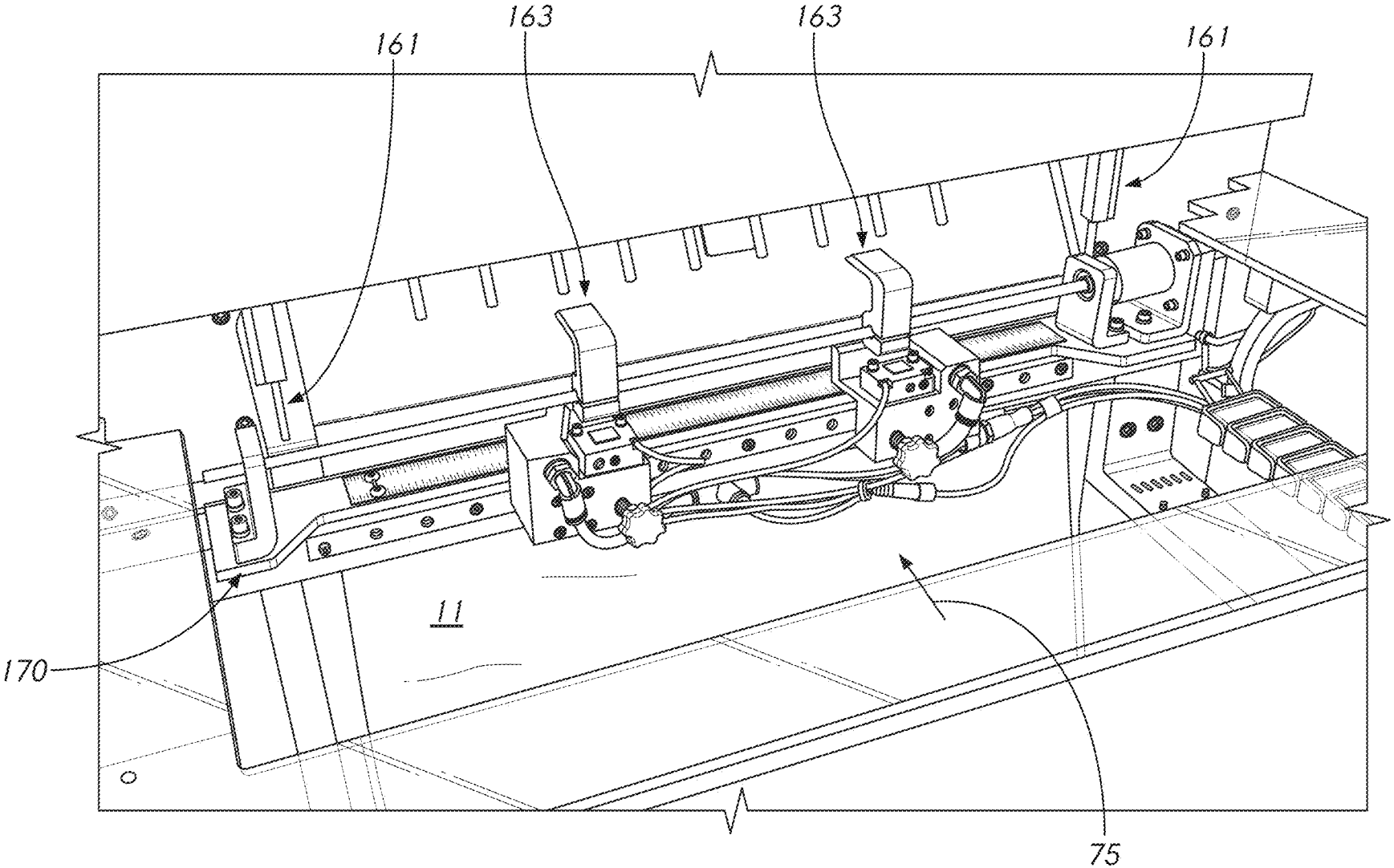
Figure 15C:
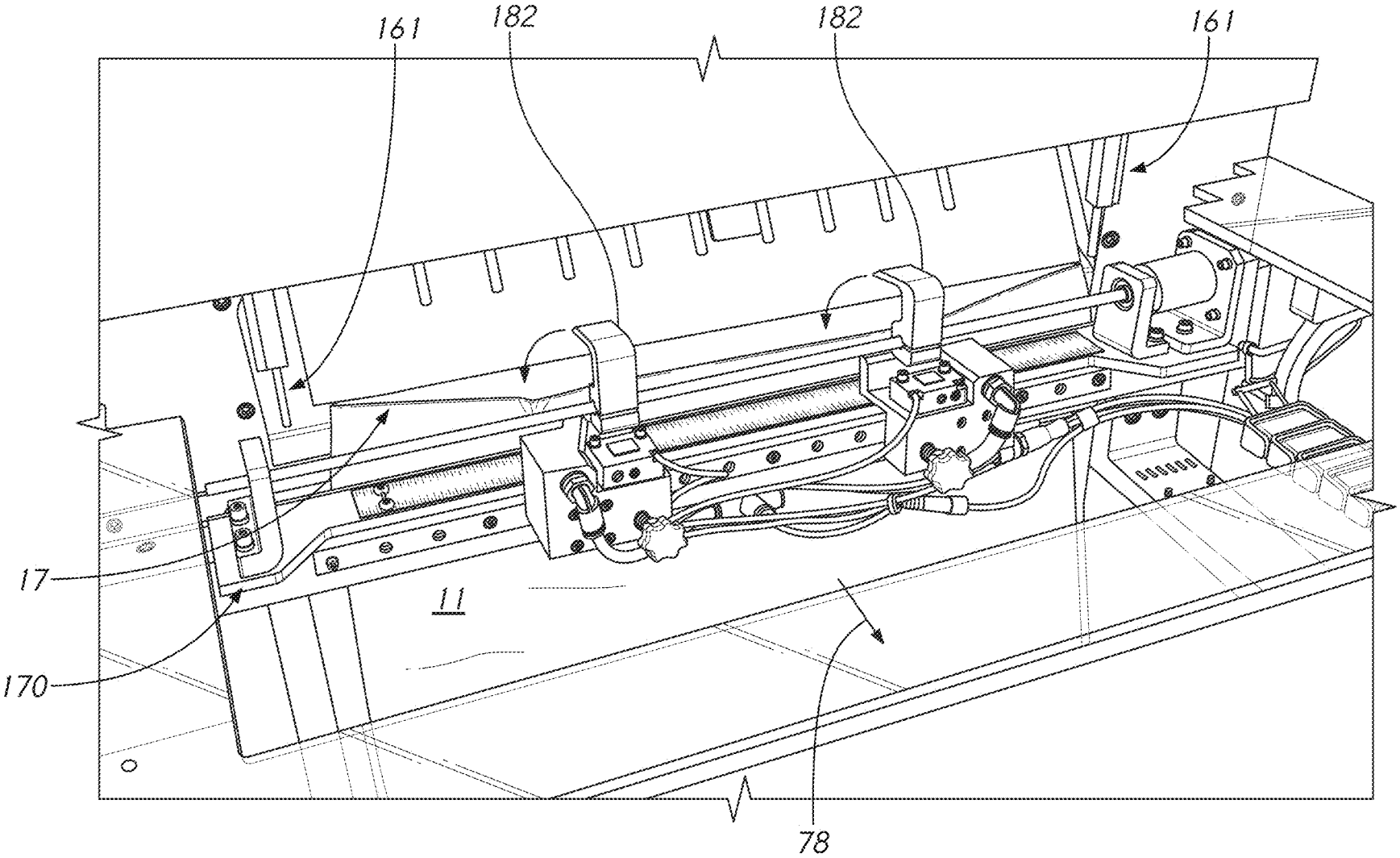
Figure 15D:
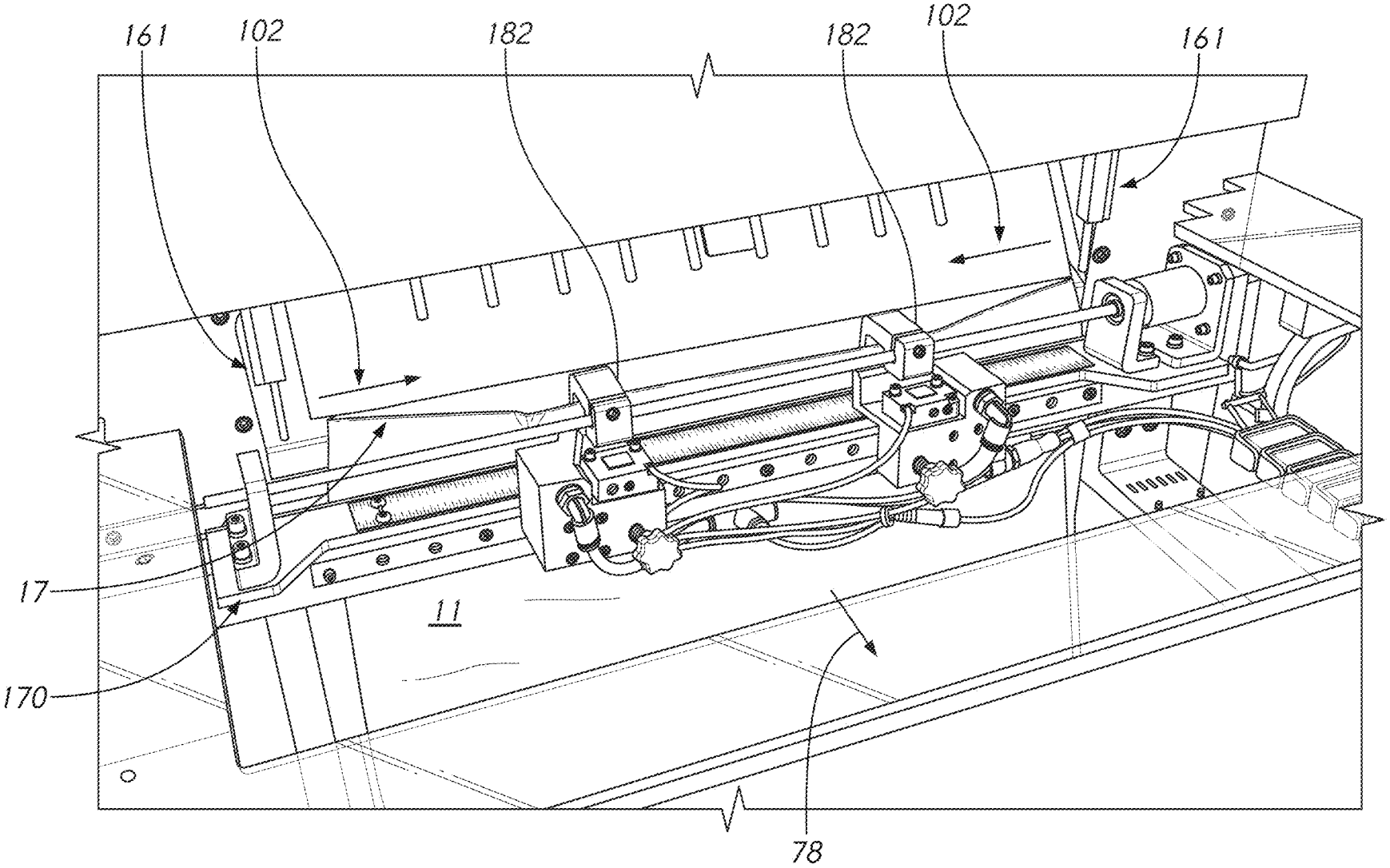
Figure 15E:
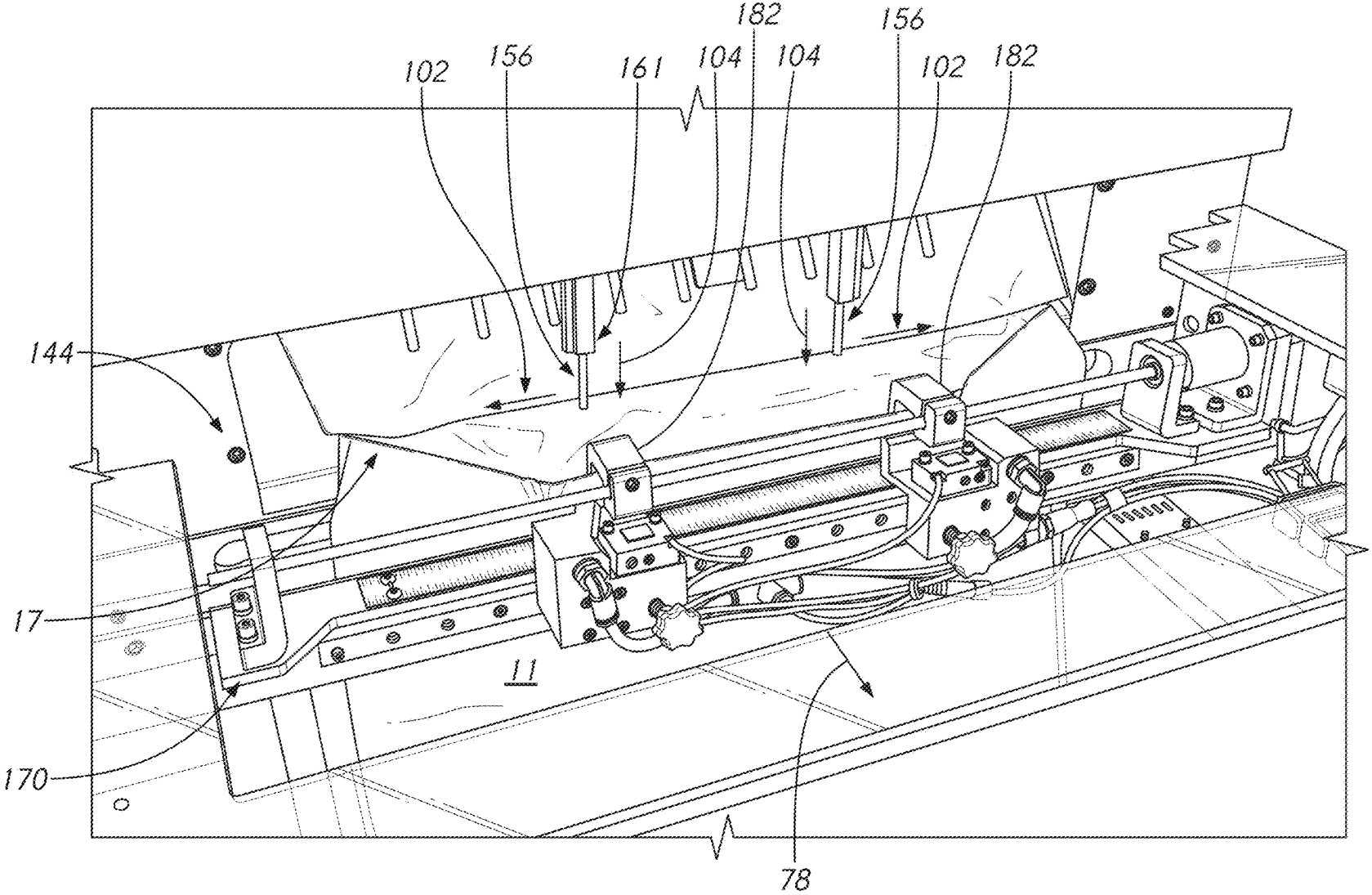

An operational sequence may begin with the web 12 advancing until the bag opening is positioned above the bag sealing area 145, as shown in FIG. 15A. The amount of web advancement to properly position the bag opening may be programmed into the controller sequence based on the bag length (that is, the system may, each time, advance the same amount of web) or alternatively computer vision (e.g., an optical sensor) may be used at the inlet 144 to pause the advancement of the web 12 when the presence of the perforations is at an appropriate location of the bag inlet 144. As shown in FIG. 15B, the sequence continues with the initial opening of the bag 11. The bagging machine may utilize a vacuum assist device 177 (and/or an air knife or other suitable device) to slightly enlarge the bag opening 17 to allow for the insertion of the fingers (e.g., rear fingers 161 and front moveable fingers 182) into the opening 17. In this and previous stages, the rear film-control elements (e.g., fingers 161) may be in a disengaged position relative to the web 12 (e.g., in this example, positioned outward of a perimeter of the web). As shown in FIG. 15C, after the initial opening is provided, the front film-control elements are deployed (e.g., fingers 182 are rotated down into the bag opening 17 to grip the front side of the bag). At this time, the rear film-control elements (fingers 161) are also deployed, and as shown in FIG. 15D, the rear fingers 161 are moved towards the centerline of the inlet 144, as shown by arrows 102. In some embodiments, the rear fingers 161 are translated inward to positions in which the rear fingers 161 substantially align with the front fingers 182, at which point they may be transversely extended into the bag opening 17. In other embodiments, the fingers 161 may be advanced to different transverse positions (e.g., to a position in which they are closer together than the front fingers 182) before they are extended into the bag. In the case of telescoping fingers 161, for example, air pressure may be used to deploy the telescoping portion into the bag (e.g., via a release of pressurized air against the telescoping portions 156 of the fingers 161). As shown in FIG. 15E, the extension of the fingers 161 into the bag (along direction 104) may be performed concurrently with (or shortly before) the spreading outward of the fingers 161 (along direction 102) and also while the front fingers 182 are advanced away from the bag inlet 144 (along the opening direction 78), which causes the bag opening 17 to become tautly engaged between the rear and front fingers 161, 182, as shown in FIG. 15F.

Figure 15F:
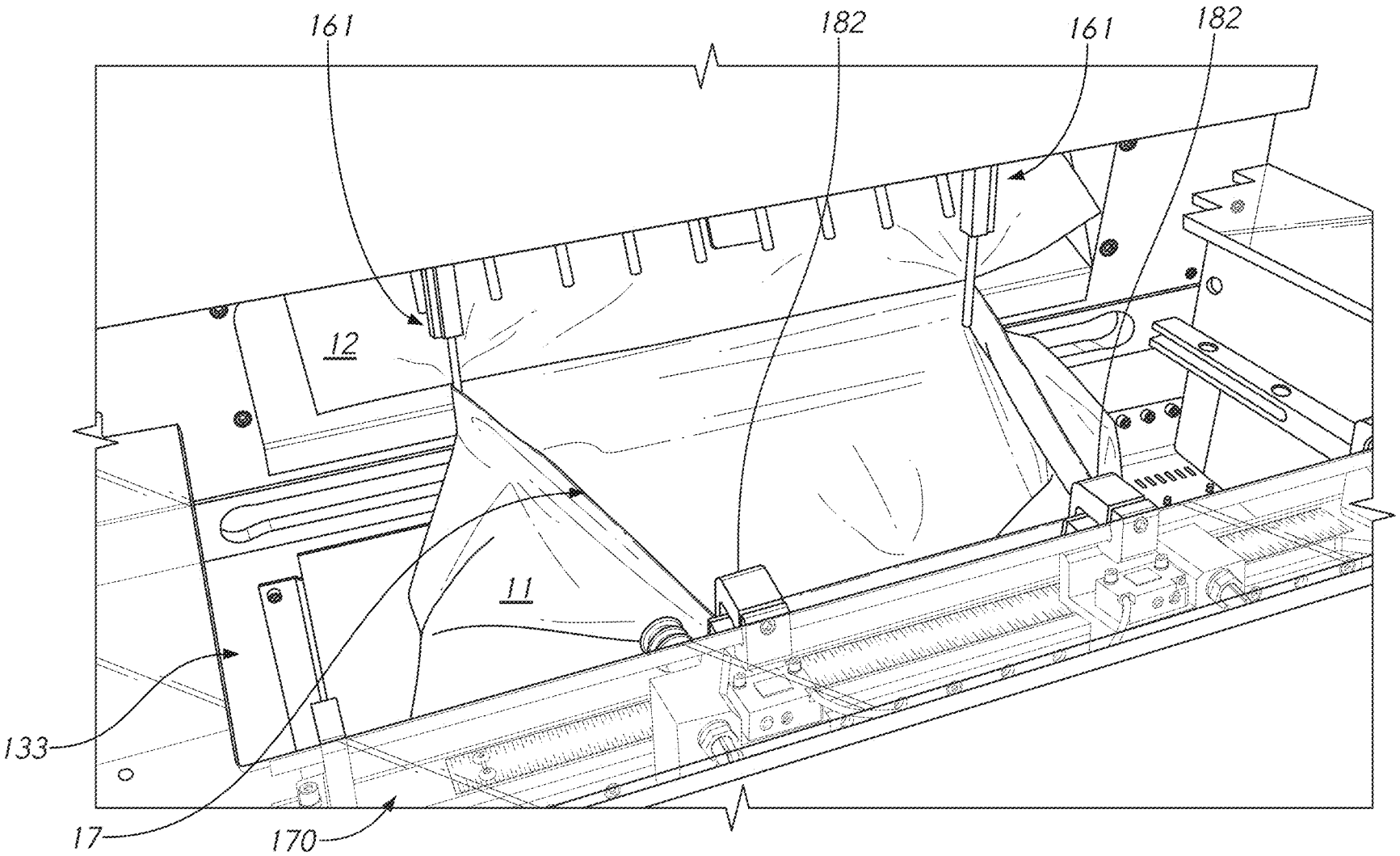

As shown in FIG. 15F, leading up to this point, a portion of the rear perforation, near the longitudinal edges of the web 12 may tear or have torn, however a least a portion (e.g., up to 50% and typically more than 50%) of the rear perforations remain intact to keep the bag 11 attached to the web 12 until product loading is complete. At this point, the bag 11 is ready for product to be loaded into it, which may be performed by a human operator or a robot operator (e.g., 330 in FIG. 12) controlled by the bagging machine. In the case of a human operator, the control system may display instructions to the user (e.g., for loading the bag) and/or may await operator input, which may be provided by the user placing his or her hands on the hand stations or contacts associated with a safety shroud 171 to indicate that the product has been provided in the bag 11 and that the operator's hands are free from the bagging area 133. In the case of a robot operator, a signal indicated the completion of the product loading sequence may be generated in the background and transmitted to the controller to automatically initiate the bag closing and sealing stages of the process.

Figure 15G:
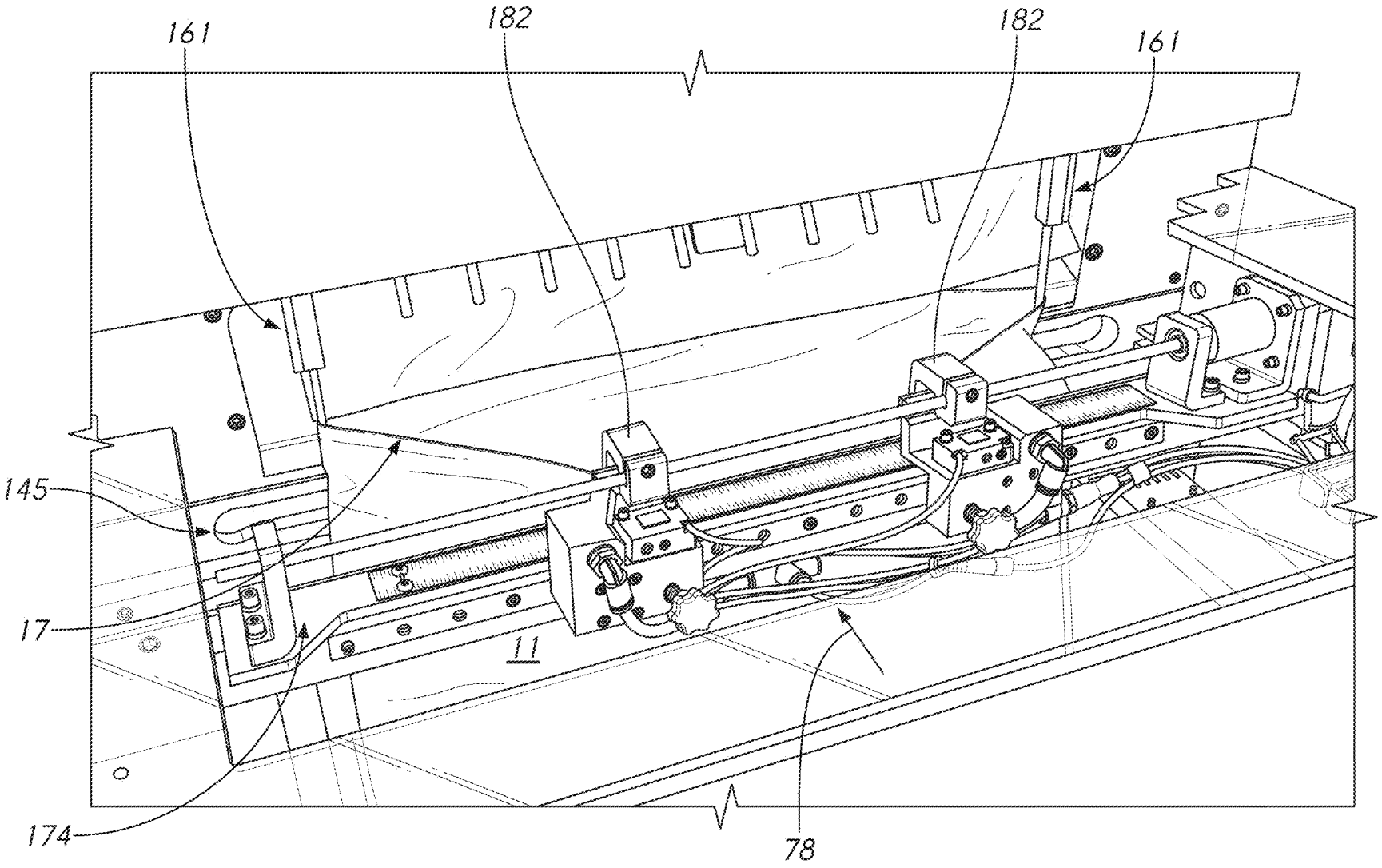
Figure 15H:
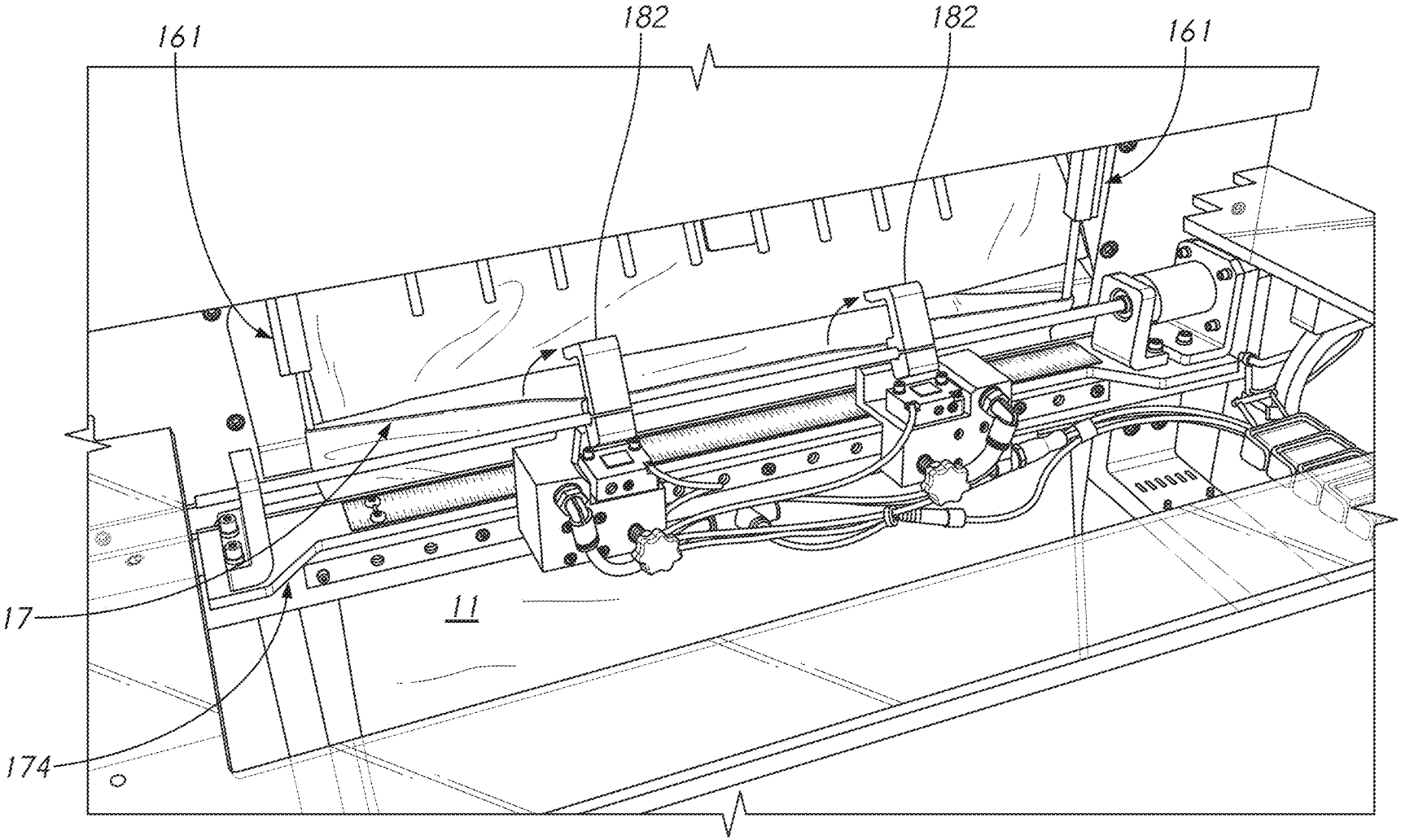
Figure 151:
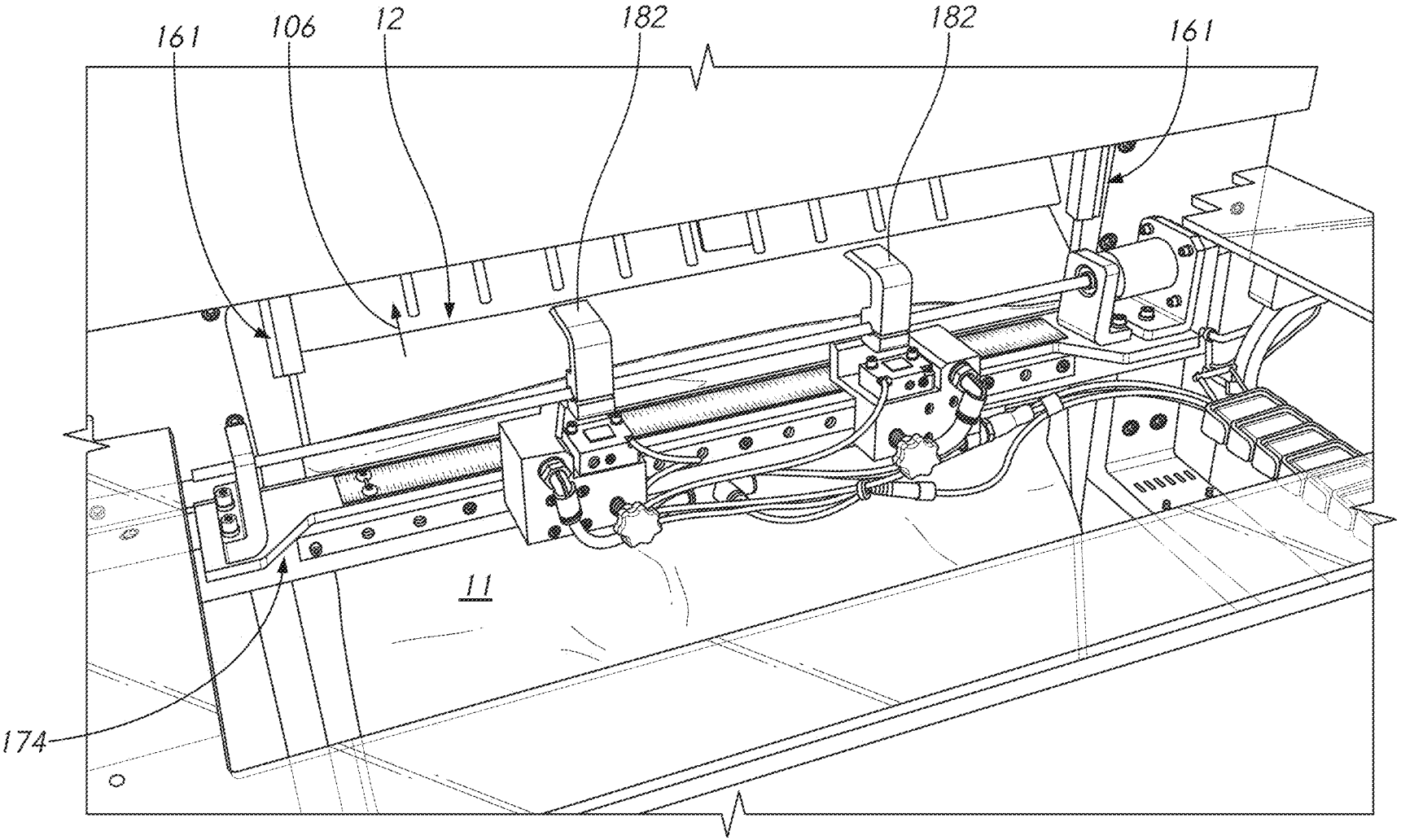

As shown in FIG. 15G, during bag closing, the pressure plate 174 is advanced in the bag closing direction 75 while the front fingers 182 remain in the closed position gripping the front side of the bag opening 17. Concurrently, the rear fingers 161 are translated outward (in the direction 102) to widen the bag opening 17 and thus flatten out the top portion of the bag 11, preparing it for the sealing operation. During the sealing operation, the pressure plate 174 is pressed against the sealing area 145 allowing the bumper on the pressure plate 174 to resiliently deform thereby applying a suitable amount of pressure against the front and rear sides of the bag to effect the sealing operation. As shown in FIG. 15H, as the pressure plate 174 engages the sealing area 145 and/or the sealing operation is complete, the front fingers 182 are disengaged from the opening 17 (e.g., pivoted to the open position), while the rear fingers 161 remain in engagement with the outer edges of the bag opening 17. This maintains the bag near the opening flat during the completion of the sealing operation. Upon completion of the sealing operation, the rear perforation is torn, for example by reversing the web (along direction 106) as shown in FIG. 15I, thereby separating the filled and sealed bag 11 and releasing the sealed bag 11 towards the bag outlet.

Having described several embodiments herein, it will be recognized by those skilled in the art that various modifications, alternative constructions, and equivalents may be used. The various examples and embodiments may be employed separately or they may be mixed and matched in combination to form any iteration of the alternatives. Additionally, a number of well-known processes and elements have not been described in order to avoid unnecessarily obscuring the focus of the present disclosure. Accordingly, the above description should not be taken as limiting the scope of the invention. Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A bagging machine comprising:

a supply handling assembly configured to support a supply of converted web material and to feed the converted web material toward a bag loading area of the machine, wherein the supply of converted web material comprises a plurality of individual bags connected in a continuous web with transverse perforations extending at least partially along a transverse dimension of the web to define openings of the individual bags;

a bag loading assembly configured to open individual bags of the continuous web as the web enters the bag loading area through a bag inlet, the bag loading assembly comprising:

a rear bag-handling assembly comprising at least one first bag-handling element operatively associated with the bag inlet to control a rear side of the opening of an individual bag;

a bag opening assembly movable relative to the bag inlet and comprising:

a second bag-handling element configured to engage a front side of the opening, a pressure plate supporting the second bag-handling element and configured to reciprocate relative to the bag inlet for opening and closing the individual bags, and a sensor mounted in a fixed relationship to second bag-handling element and positioned to detect a presence of a bag between gripper portions of the second bag-handling element; and a control system in communication with the sensor and configured to change an operational sequence of the bag opening assembly based on data received from the sensor.

2. The bagging machine of claim 1 wherein the control system is configured to interrupt an opening sequence responsive to a determination that the bag is not present between the gripper portions of the second bag-handling element during the opening sequence.

3. The bagging machine of claim 2, wherein the control system is further configured to generate an alert responsive to a determination that the bag is not present between the gripper portions of the second bag-handling element.

4. The bagging machine of claim 2, wherein the control system is further configured to re-start the opening sequence responsive to a determination that the bag is not present between the gripper portions of the second bag-handling element.

5. The bagging machine of claim 1, wherein the at least one first bag-handling element comprises a pair of first fingers moveably coupled to a frame of the bagging machine such that the first fingers are positionable to extend transversely across the bag inlet during a bag opening operation of the bagging machine.

6. The bagging machine of claim 5, wherein at least a portion of each of the first fingers is configured to move in a direction transverse to the bag inlet between an extended position, in which the first fingers are extended into the opening of the bag, and a retracted position, in which the first fingers do not extend into the opening of the bag when the bag is provided in the bagging area.

7. The bagging machine of claim 6, wherein each of the first fingers comprises a telescoping member including a fixed portion and a telescoping portion, the telescoping potion configured to move toward and away from the fixed portion to provide the first fingers between the retracted and extended positions, respectively.

8. The bagging machine of claim 6, wherein the first fingers are moveable between a plurality of engaged positions along a length of the bag inlet, in which the first fingers extend into the opening of the individual bag during opening and closing of the individual bag, and at least one non-engaged position along the length of the bag inlet, in which the first fingers do not extend into a bag during advancement of the web to position a next bag in the bag loading area.

9. The bagging machine of claim 8, wherein the first fingers are configured to move in symmetric opposition during opening of the bag.

10. The bagging machine of claim 1, wherein the second bag-handling element comprises a finger assembly including a first gripper portion and a second gripper portion, the first gripper portion moveable with respect to the second gripper portion between a closed position in which a contact surface of the first gripper portion is positioned opposite a contact surface of the second gripper portion, and an open position in which the respective contact surfaces of the first and second gripper portions are farther apart than in the closed position.

11. The bagging machine of claim 10, wherein the first gripper portion is pivotally coupled to the pressure plate.

12. The bagging machine of claim 10, wherein the finger assembly is movably coupled to the pressure plate for adjusting a location of the gripper assembly along a length of the pressure plate.

13. The bagging machine of claim 10, wherein the first and second fingers include respective sensor apertures configured to at least partially align when the finger assembly is in a closed configuration to define a through passage through the first and second fingers.

14. The bagging machine of claim 10, wherein the sensor comprises an optical sensor positioned such that a line of sight of the sensor aligns with the through passage.

15. The bagging machine of claim 1, wherein the supply handling assembly includes a spindle configured to support a roll of the converted web material.

16. The bagging machine of claim 1, wherein the supply handling assembly includes a bag support structure configured to support a fan-folded supply of the converted web material.

17. The bagging machine of claim 1, wherein the pressure plate comprises a resiliently compressible bumper along a side of pressure plate facing the inlet.

* * * * *